US006712327B1

(12) United States Patent
Carney, Jr.

(10) Patent No.: US 6,712,327 B1
(45) Date of Patent: Mar. 30, 2004

(54) COMPUTER DOCUMENT HOLDER

(76) Inventor: Robert S. Carney, Jr., 4232 Colfax Ave. South, Minneapolis, MN (US) 55409

( * ) Notice: Subject to any disclaimer, the term of this patent is extended or adjusted under 35 U.S.C. 154(b) by 0 days.

(21) Appl. No.: 10/266,810

(22) Filed: Oct. 8, 2002

(51) Int. Cl.[7] ..... B41J 11/02
(52) U.S. Cl. ..... 248/442.2
(58) Field of Search ..... 248/442.2, 443, 248/444, 441.1, 465.1, 459

(56) References Cited

U.S. PATENT DOCUMENTS 4,313,112 A * 1/1982 Foster ..... 248/639
4,466,593 A * 8/1984 Odenath ..... 248/455
4,475,705 A 10/1984 Henneberg et al.
4,541,749 A * 9/1985 McCoy ..... 400/613.2
4,657,214 A 4/1987 Foster
4,893,775 A 1/1990 Long
5,037,056 A * 8/1991 Thompson ..... 248/441.1
5,443,237 A 8/1995 Stadtmauer
5,452,876 A 9/1995 Hatcher
6,010,262 A 1/2000 Linyear et al.
6,042,075 A 3/2000 Burch, Jr.
6,109,585 A 8/2000 Burch, Jr.
6,425,567 B2 * 7/2002 Schutze ..... 248/452
6,464,197 B1 * 10/2002 Chen ..... 248/687

* cited by examiner

*Primary Examiner*—Leslie A. Braun
*Assistant Examiner*—A. Joseph Wujciak, III
(74) *Attorney, Agent, or Firm*—Dorsey & Whitney LLP

(57) ABSTRACT

A free-standing computer document holder, having a rectangular viewing surface with a front top flange, and supported by right and left quadrilateral side structures having longer rear side edges and shorter front side edges. Due to the unequal length of the front and rear side edges, documents are supported and presented to a computer user at an angle to a work surface, such that the top of a document is above the bottom of the document. The computer document holder is situated above a computer keyboard, and is in front of, and/or over, and/or to the rear of, the keyboard. The computer user can operate the keyboard and/or a mouse while the computer document holder is situated as described. An optional monitor riser may be used to position the monitor such that the computer document holder does not obstruct a full view of the screen.

16 Claims, 24 Drawing Sheets

FIG. 8a
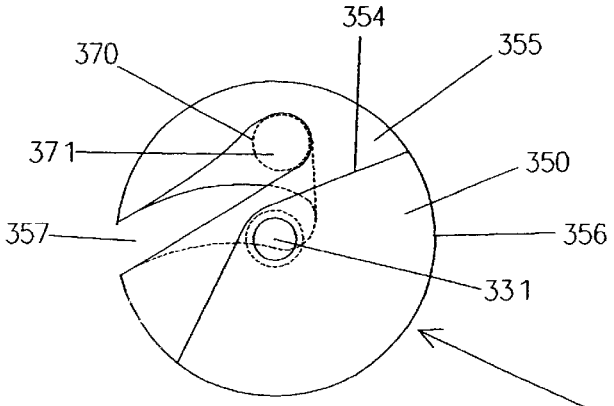
FIG. 8b
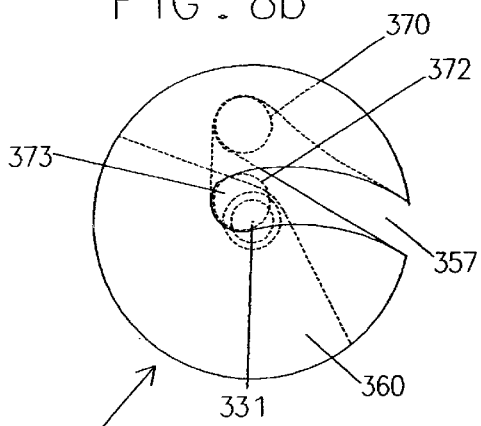
330
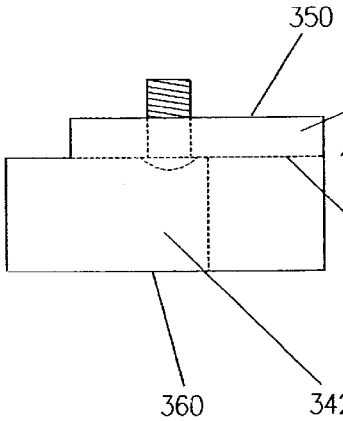
FIG. 8c
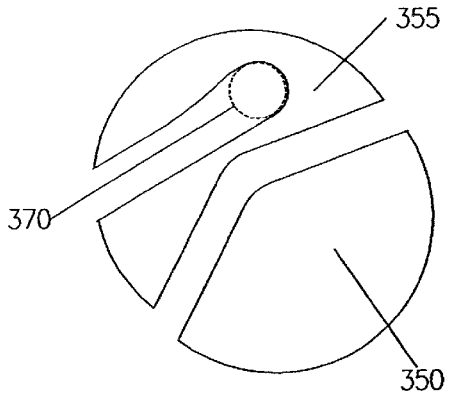
FIG. 8d
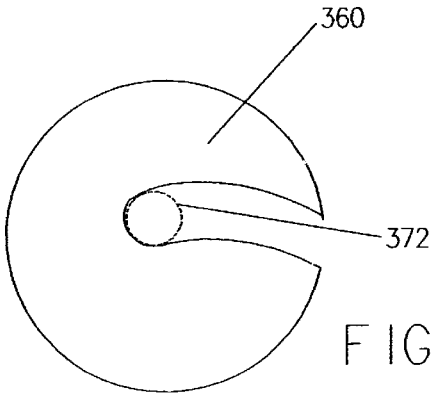
FIG. 8e FIG. 8f
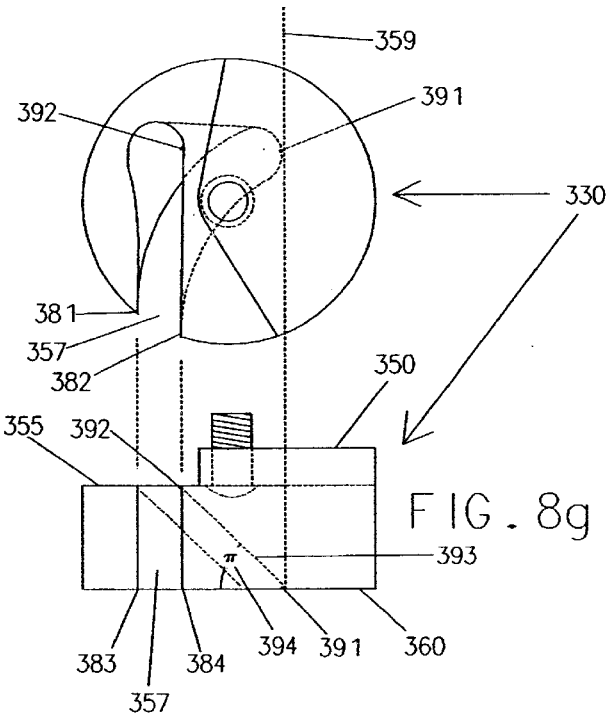
FIG. 8g
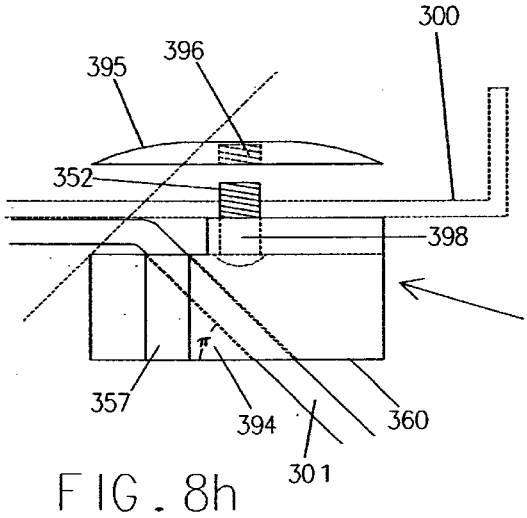
FIG. 8h
FIG. 8i
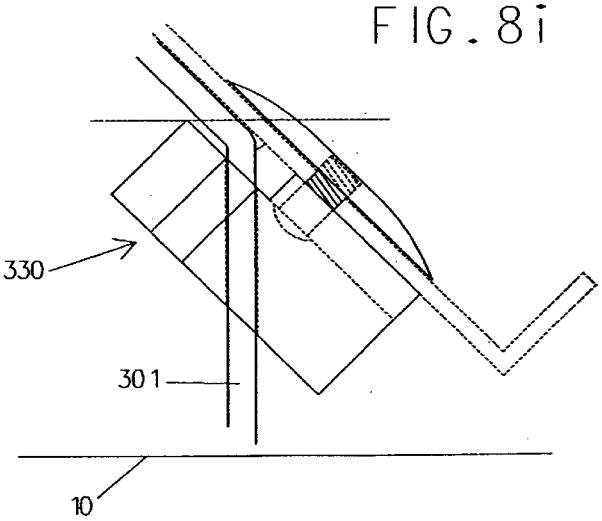

COMPUTER DOCUMENT HOLDER

TECHNICAL FIELD

The present invention relates generally to a class of devices often referred to as document holders, or copy holders. The present invention relates particularly to document holders and copy holders used with computers, and other devices having screens for the display of information.

BACKGROUND OF THE INVENTION

A variety of document holders and copy holders have been invented, to assist people both in supporting heavier objects, such as large books, and to allow people to conveniently view written and graphic information while having the free use of their hands. In general, the variety of features of different document holders is driven by the variety of circumstances in which people view documents, and associated ergonomic issues. As examples, document holders have been devised to facilitate reading documents while in cars, and to facilitate reading in bed.

BRIEF DESCRIPTIONS OF PRIOR ART

Because the focus of the present invention is to facilitate reading and viewing documents while using a computer or a similar device, the scope of this background information will be first narrowed to document holders used with computers, and further narrowed to document holders that situate documents below the screen, rather than to one side. Only a very brief description is provided for each invention; the reader is referred to the cited patents for complete information.

U.S. Pat. No. 4,475,705 (October 1984) discloses a document holder that mounts on a display terminal, and presents a document to a preferred side of the terminal. Horizontal eye movement may thus be required over both the width of the monitor screen and the width of the document.

Remaining patents described here are for document holders that situate documents below the screen, rather than to one side.

U.S. Pat. No. 4,657,214 (April 1987), discloses a document holder comprising two hinged document supporting components situated over a keyboard on a sliding platform that can be located in a forward position and a rearward position with respect to the monitor. When the keyboard is in a forward, or operating position, both hinged document supporting components form a surface for supporting documents. When the keyboard is in a rearward position, it can be enclosed and protected by the lower hinged document supporting component.

U.S. Pat. No. 4,893,775 (January 1990) discloses a copy holder comprising a planar rectangular base section placed beneath a computer, a second section attached to the base section and angled to the rear of the computer at an angle of about 70 to 85 degrees, and hinged to a third, document supporting section having an adjustable shelf with which to support documents. The third, document supporting section can be placed in either an upward position to support documents, or in a lowered position to allow access to disk drives.

U.S. Pat. No. 5,443,237 (August 1995) discloses a computer keyboard support system, mounted on an under surface of a work table, comprising a means to pull the keyboard out from under the work table, and comprising a height adjustable document holder.

U.S. Pat. No. 5,452,876 (September 1995) discloses a copy holder for use in-line with a monitor stand, comprising a means for supporting a monitor above a work surface, and a copy holder that may be slid forward from a tray, to a position forward of the monitor, and at an angle of about 22 degrees.

U.S. Pat. No. 6,010,262 (January 2000) discloses a keyboard shield and copy holder, comprising an adjustible top plate member having a document supporting flange and downward extending left and right side panels, and a bottom plate member having upward extending left and right side panels to engage the side panels of the top plate member. In use, the top plate member serves to shield the keyboard from being viewed directly, facilitating the training of typists and keyboard operators in the art known as "touch typing."

U.S. Pat. No. 6,042,075 (March 2000) discloses a computer copy holder for a keyboard drawer, comprising a keyboard drawer situated below a monitor, and containing both a keyboard and the copy holder. The copy holder comprises a base plate situated under the keyboard, and an easel that can be placed either in an upstanding position for supporting documents, or horizontally above the keyboard, thus to allow the keyboard drawer, containing both the keyboard and the copy holder, to be closed.

U.S. Pat. No. 6,109,585 (August 2000) discloses a computer copy holder and monitor riser stand, comprising a base plate situated below a keyboard, a removable and positionable upstanding easel having a document supporting lip, and supported both by a support member slidably connected to the base plate, and by a computer monitor riser.

BRIEF DESCRIPTION OF GENERAL ATTRIBUTES DESIRED OF THE PRESENT INVENTION

The practice of the present invention is intended to render a simple, inexpensive, mass market, sturdy, durable, detached and portable document holder, allowing people who use a wide variety of types and designs of computers to simultaneously and conveniently work with both their computers and with a wide variety of documents, including heavy books, that may be positioned below their monitor, or below and to one side of their monitor. To allow maximum freedom and convenience for the computer user, one particularly significant object of the present invention is to provide a free-standing document holder, allowing the computer user to operate a keyboard, and/or a mouse, while the document holder is situated in a variety of positions, including in front of, and/or over, and/or behind, the keyboard.

The present invention is also intended to be "hyperscaleable", meaning that at least one preferred embodiment can be manufactured with a relatively simple, inexpensive process, and can be both produced and marketed profitably for a very wide range of sales volume, including very small volumes during a start-up period that can range from a few months to a few years, thus facilitating commercialization of the invention. This hyperscalable aspect of the present invention has been achieved in part by devising multiple preferred embodiments, including a preferred embodiment suitable for start-up and initial production, and including a preferred embodiment that requires a greater initial capital investment, but that can render a version of the present invention that can be produced economically in large volumes, and that may be more durable than the preferred embodiment identified as most suitable for start-up production.

ASSESSMENT OF THE PRIOR ART WITH RESPECT TO GENERAL ATTRIBUTES DESIRED OF THE PRESENT INVENTION

The inventions comprising the prior art appear to compare favorably with the present invention with respect to some attributes, but to fall short with respect to other attributes. It should be noted that because the present invention is intended to be both simpler and more economical than the prior art, instances of the prior art offer some advantageous attributes that are not sought, or offered, by the present invention.

An informal analysis was conducted, and each of the eight prior art inventions briefly described above was subjectively placed on a scale from one to ten for a group of attributes, such that the present invention was considered as among the group of prior art for determining the end points of the scale. Regarding the attribute "simple", most of the summarized inventions appear to be at least moderately complex relative to the present invention. It is difficult to directly assess the attribute "inexpensive", but if "complex" can be assumed to be a proxy for "expensive", it seem likely the prior art inventions would tend to be at least moderately expensive. Regarding the attribute "mass market", the relatively higher complexity and assumed higher cost of the prior art suggests that most of the prior art inventions are not intended to be mass market products, but are "high end" products for segments of the population of all computer users who would gain the most benefit from the unique attributes offered by each prior art invention. It should be noted that U.S. Pat. No. 6,010,262 discloses a device specifically designed for people who are learning the art of "touch typing," and is not suitable for most typical computer work environments. Regarding the attributes "sturdy" and "durable" it appears the prior art would do very well with respect to both these attributes. Regarding the attribute "detached and portable", some instances of the prior art appear to require extensive installation, while other instances are quite easily portable. Regarding the attribute "useable by people who use a wide variety of computer types, and with a wide variety of documents," it appears that this attribute is applicable to most of the prior art. Regarding "positioning attributes respective to the monitor and the keyboard", each of the prior art inventions allows documents to be positioned below the monitor, and some of the prior art inventions explicitly describe positioning documents below and to one side of the monitor. Three of the prior art U.S. Pat. Nos. 4,657,214, 5,443,237, and 6,010,262, appear to specifically provide for positioning either behind and/or above the keyboard.

SUMMARY OF THE INVENTION

The present invention comprises a computer document holder, having a front top flange for supporting documents, an optional rear bottom flange, a rectangular viewing surface that is contiguous with the front and rear flanges, and supported by two quadrilateral side structures. Each side structure has a base edge dimension of approximately nine inches. At the front quadrilateral edge of the document holder each side structure extends upward approximately five inches from a work surface. At the rear quadrilateral edge of the document holder, each side structure extends upward approximately ten inches from a work surface. The unequal lengths of the front and back quadrilateral edges of the side structures positions the document holder rectangular viewing surface at an angle with respect to a work surface, such that documents rest on the front flange, and the rear of each document is elevated above the front of the document with respect to the work surface, for convenient viewing.

The document holder is used with a computer, and is placed on a work surface, such that the keyboard is on the same work surface, and the document holder is above the computer keyboard. The document holder may be situated such that it is completely in front of the keyboard, partially over and partially in front of the keyboard, directly over the keyboard, partially over and partially to the rear of the keyboard, partially in front of, partially over, and partially to the rear of the keyboard, or completely to the rear of the keyboard. The computer user can operate the keyboard, and/or the mouse, while the document holder is situated in any of the ways just previously described above. The dimensions of the rectangular viewing surface are: approximately ten inches for the two opposite, shorter edges that are contiguous with the side structures, and can be in a range from approximately twenty inches to approximately thirty six inches for the remaining two opposite, longer edges.

The present invention also comprises an optional monitor riser, which is used to position the monitor such that the document holder does not obstruct a full view of the screen. Because work station configurations vary, in some cases the height of the monitor screen is such that a monitor riser is not required.

Additional aspects integral to the present invention, including but not limited to: manufacturing processes associated with specific preferred embodiments, a portable embodiment having folding quadrilateral leg structures, and a preferred embodiment having decorative attributes, may be found in the Detailed Description of the Invention section, by inspection of the drawings, by practice of the invention, and may become apparent by considering the totality of the information provided here.

BRIEF DESCRIPTION OF THE DRAWINGS

FIG. 8*a* is a top view of a second preferred embodiment leg securing device FIG. 8*b* is a bottom view of a second preferred embodiment leg securing device FIG. 8*c* is a side view of a second preferred embodiment leg securing device FIG. 8*d* is a top exploded view of surfaces of a second preferred embodiment leg securing device FIG. 8*e* is a bottom view of a surface of a second preferred embodiment leg securing device FIG. 8*f* is a top view of a second preferred embodiment leg securing device FIG. 8*g* is a side view of a second preferred embodiment leg securing device FIG. 8*h* is a side view of a second preferred embodiment leg securing device FIG. 8*i* is a side view of a second preferred embodiment leg securing device

DETAILED DESCRIPTION OF THE INVENTION

Four preferred embodiments of the present invention are presented. The first preferred embodiment is detailed with respect to both structural features and manufacturing process features. A first preferred embodiment has been devised to be suitable for rendering a production version of the present invention that is economical for both start-up production and low-volume production. A second preferred embodiment has been devised to render the present invention suitable for people who desire a portable version, having folding leg structures. A third preferred embodiment has been devised to render a high-volume production version of the present invention, one that requires a substantial initial investment, but offers a finished product that is potentially of comparable expense relative to the first preferred embodiment, and that may be more durable than the first preferred embodiment. A fourth preferred embodiment is a more decorative rendering of the present invention, having attributes associated with woodworking and fine furniture.

First Preferred Embodiment

Figure 1:
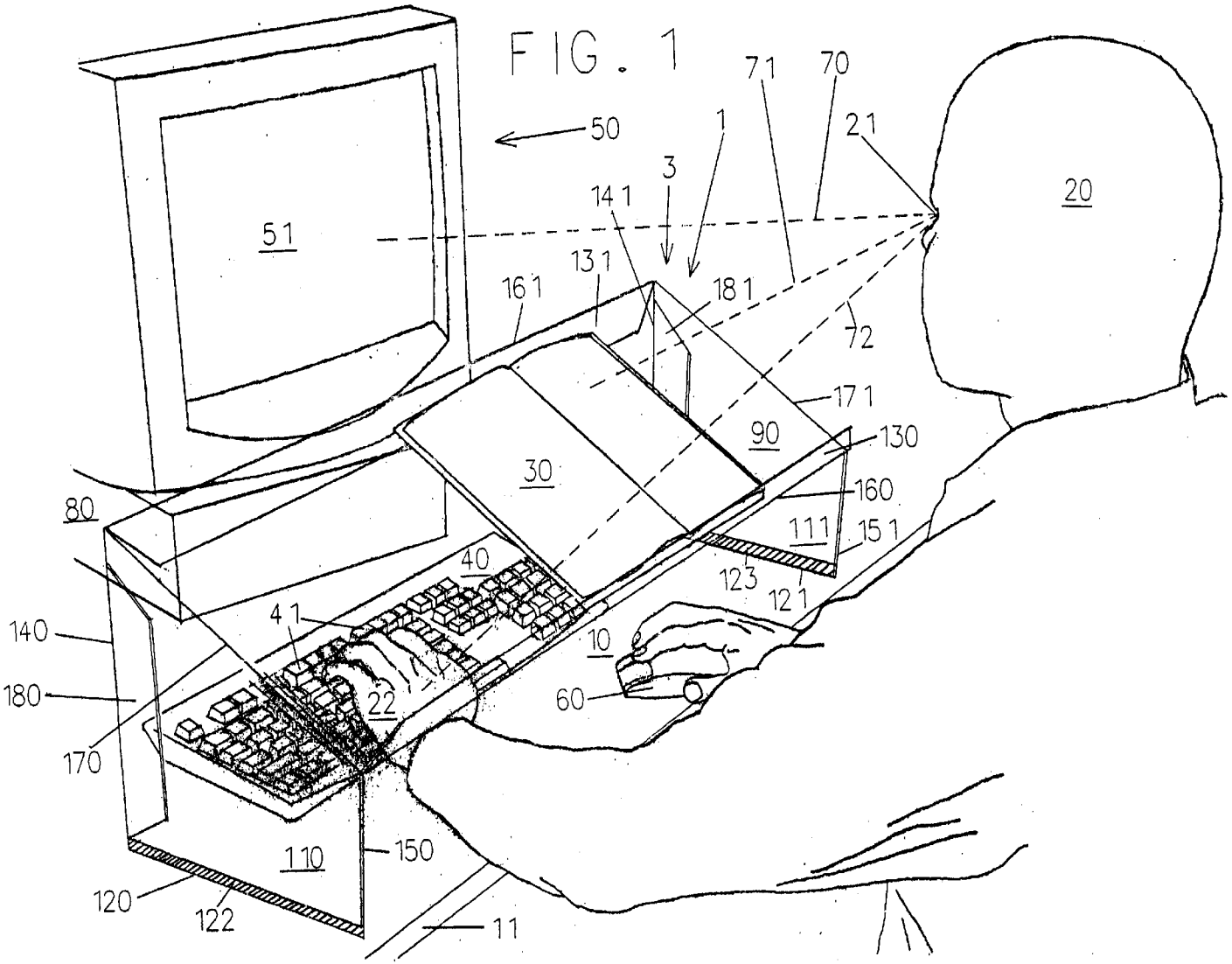
FIG. 1 is a top side perspective of a first preferred embodiment in use.

FIG. 1 illustrates a first preferred embodiment of the present invention in use. The free-standing computer document holder, 1, is positioned on a work surface, 10, having a work surface edge 11, and is situated in front of, and/or over, and/or to the rear of, a computer keyboard, 40. The computer document holder, 1, has a rectangular viewing surface, 90, having left and right shorter sides, 170 and 171, respectively, of an equal length of approximately ten inches. One function of the rectangular viewing surface, 90, is to support and present documents, such as the book, 30, to a computer user, 20. The rectangular viewing surface, 90, is supported, and positioned at an angle to the work surface, 10, by left and right quadrilateral sides, 110 and 111, respectively. Because the length of the left and right quadrilateral side rear edges, 140 and 141, respectively, is greater than the length of the left and right quadrilateral side front edges, 150 and 151, respectively, the top of a document, 30, on the rectangular viewing surface, 90, is elevated above the bottom of the document with respect to the work surface, 10.

The left and right quadrilateral sides, 110 and 111, respectively, have upper edges, 170 and 171, respectively, rendered by heat forming the single, sized, sheet of thermoplastic material, 3, such that each quadrilateral side, 110 and 111, is on a plane at approximately a 90 degree angle to the plane of the rectangular viewing surface, 90. The left and right quadrilateral sides, 110 and 111, respectively, have two quadrilateral side bottom edges, 120 and 121, respectively, that rest on the work surface, 10. The left and right quadrilateral side bottom edges, 120 and 121, respectively, may optionally have an encasing outer surface of a rubbery material, 122 and 123, respectively, such that the document holder, 1, will not slide on the work surface, 10. A stand-alone monitor riser, 80, is situated on the work surface, 10, beneath a computer monitor, 50, such that the computer monitor is elevated, and such that all of the monitor screen, 51, is visible above the documents displayed by the document holder, 1, with respect to the line of site, 70, of a computer user, 20. It should be noted that when the present invention is in use, in some work station configurations the monitor riser, 80, will not be needed, because the use of the document holder, 1, will not obstruct the view of the full monitor screen, 51. The computer user, 20, is using the keys, 41, of the keyboard, 40, to enter data into the computer (not illustrated).

In general, to allow maximum freedom and convenience for the computer user, the computer document holder of the first preferred embodiment is free-standing, allowing the computer user to operate a keyboard, and/or a mouse, while the document holder is situated in a variety of positions, including in front of, and/or over, and/or behind the keyboard. This freedom and convenience for the computer user can be seen from the arrangement of the elements of FIG. 1.

The first preferred embodiment computer document holder, 1, illustrated in FIG. 1, is rendered from a single, sized, heat formed sheet of transparent thermoplastic material, 3, a choice of materials that affords the user the ability to see both documents and the user's operation of the keyboard with hands and fingers. However, it should be understood that document holders of the first preferred embodiment can be constructed with other plastic material that is not transparent. Continuing to refer to FIG. 1, the computer user, 20, has convenient, unobstructed views, shown by three dashed lines-of-site, as follows: A first line of site, 70, illustrates the unobstructed view from the computer user's eyes, 21, to the monitor screen, 51. A second line of site, 71, illustrates the unobstructed view from the computer user's eyes, 21, to an open book, 30, placed on the document holder, 1, and supported and presented to a computer user. A third line of site, 72, illustrates the unobstructed view from the computer user's eyes, 21, to the computer user's hand, 22, which is keying data using keys, 41, of the keyboard, 40. It should be noted that if documents are placed along the entire length of the computer document holder, 1, the computer user, 20, will not have an unobstructed view of the keyboard, 40.

Continuing to refer to FIG. 1, the computer document holder, 1, comprises folded edges that serve structural functions. The book, 30, and other documents (not illustrated), including heavy documents, are supported by a front top flange, 130, that is rendered by heat forming along the front folded edge, 160, of the rectangular viewing surface, 90, such that the front top flange, 130, rises above the rectangular viewing surface, 90, at approximately a 90 degree angle to the rectangular viewing surface, 90. In addition to providing support for documents, this front top flange, 130, adds structural rigidity to the viewing surface, 90, such that the viewing surface, 90, will not tend to sag under the weight of heavy documents.

A rear bottom flange, 131, is rendered by heat forming along the rear folded edge, 161, of the rectangular viewing surface, 90, falling below the rectangular viewing surface, 90, at an acute angle of about 135 degrees, such that it is approximately perpendicular to the work surface, 10. This rear bottom flange, 131, also adds structural rigidity to the rectangular viewing surface, 90. The structural support afforded by the flanges, 130 and 131, to the rectangular viewing surface, 90, is such that the front and back longer sides, 160 and 161, respectively, of the rectangular viewing surface, 90, can easily be 36 inches in length, or more, while still supporting a substantial weight of documents. In general, the first preferred embodiment can be rendered with the long sides of the rectangular viewing surface, 90, having equal lengths, ranging from about 20 inches (accommodating the length of most computer keyboards), to 36 inches, or more. It should be understood that an alternative embodiment of the present invention, suitable for lighter duty applications, may be rendered without the rear bottom flange.

Continuing to refer to FIG. 1, the computer document holder, 1, comprises additional folded rear edges, 140 and 141, for each of the two sides, 110 and 111, respectively. The folded rear edges, 140 and 141, are rendered by heat forming protruding side sections, 180 and 181, respectively, of the single, sized, heat formed sheet of thermoplastic material, 3, such that when folded, the protruding side sections, 180 and 181, respectively, are in contact with the inner surface of the two quadrilateral sides, 110 and 111, respectively, and such that the lines, 140 and 141, along which the protruding side sections, 180 and 181, respectively, are folded, constitute the rear edge of the quadrilateral sides, 110 and 111, respectively. These folded rear edges, 140 and 141, add structural rigidity to the rear quadrilateral edge of each of the two sides, 110 and 111, respectively. Because the rear quadrilateral edges of the sides, 140 and 141, are of greater length relative to the front edges, 150 and 151, (about ten inches and five inches respectively), this additional structural rigidity on the rear quadrilateral edges, 140 and 141, while beneficial to the overall function of the document holder, is not required for the front quadrilateral edges, 150 and 151. However, it should be understood that a variation of the first preferred embodiment can include folded front edges to the sides, 110 and 111, of the document holder 1, rendered in a way similar to the folded rear edges, 140 and 141. It should also be understood that the present invention can be practiced without folded rear edges, 140 and 141, although such a rendering is less rigid and solid.

Figure 2:
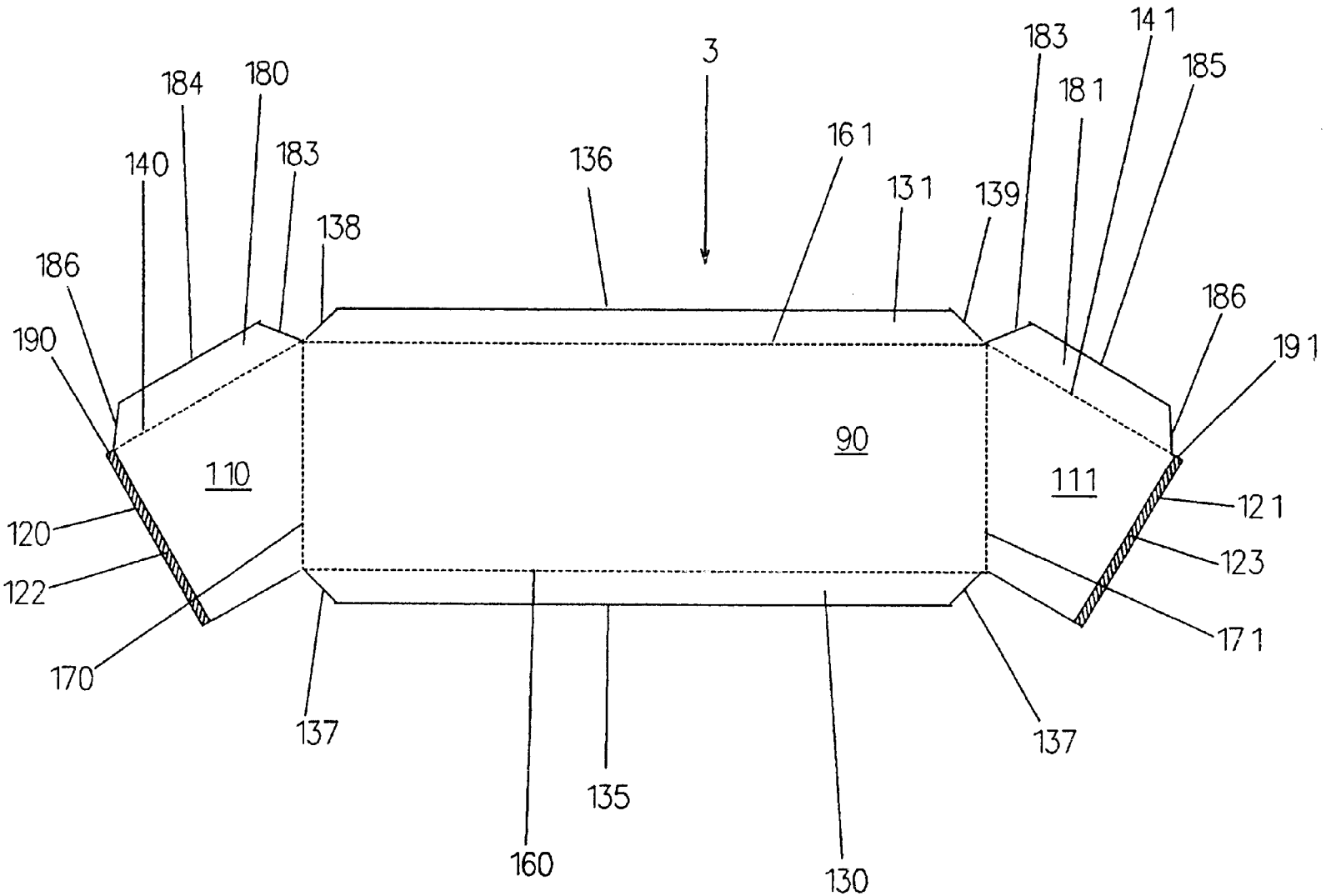
FIG. 2 is a top view of a sheet of material used to form a larger version of a first preferred embodiment
Figure 3:
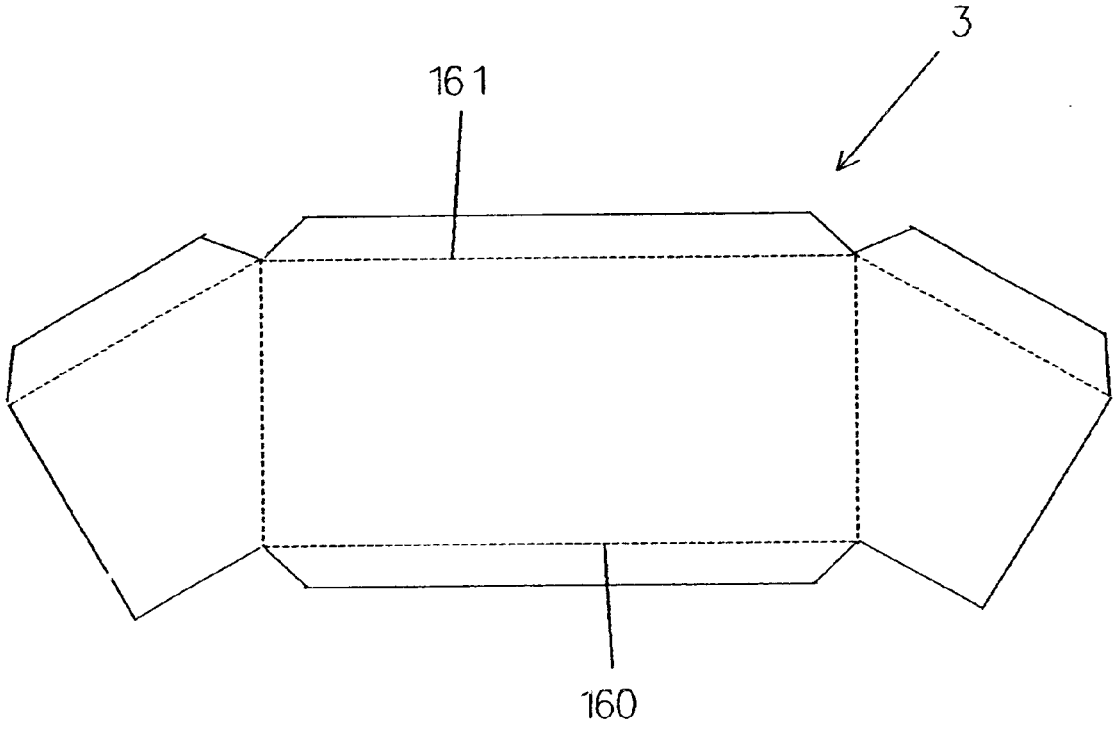
FIG. 3 is a top view of a sheet of material used to form a smaller version of a first preferred embodiment

FIG. 2 illustrates a top view of a single, sized sheet, 3, of thermoplastic material, after it has been cut to size, to be rendered into the first preferred embodiment. The dashed lines of FIG. 2 indicate where the material is to be folded during heat forming. FIG. 2 illustrates a rendering having dimensions of approximately 30 inches for the longer sides, 160 and 161, of the viewing surface, 90. As noted above, this long side dimension, 160 and 161, can be varied, from about 20 inches, to 36 inches, or more. FIG. 3 illustrates a view similar to FIG. 2 in all respects except one: the longer side in FIG. 3, as represented by the edges, 160 and 161, has a dimension of approximately 20 inches, rather than approximately 30 inches as in FIG. 2.

Referring again to the single, sized thermoplastic sheet, 3, of FIG. 2, each of the flanges and folded edges that are formed to render the document holder are successively heat formed by the following process. First, heat is applied to the material, as described above, along a dashed line. The process of heating the material will be detailed below, with reference to FIG. 5*a* through FIG. 6*b*. When the material has been brought to the desired temperature, then, through the use of a mold, jig, or other device, the flange or folding edge is formed.

Referring again to FIG. 2, the protruding sections, 180 and 181, that are folded to form the rear side edges, 140 and 141, respectively, of the quadrilateral sides, 110 and 111, respectively, have angled ends, 183 and 186, respectively, such that the outer edges, 184 and 185, respectively, of the protruding sections, 180 and 181, are shorter than the folding lines, 140 and 141, respectively, that form the folded rear side edges of the two quadrilateral sides, 110 and 111, respectively, of the computer document holder. For structural support, it is not necessary that the outer edges, 184 and 185, of the protruding sections, 180 and 181, respectively, be as long as the rear side edges, 140 and 141, respectively, of the quadrilateral sides, 110 and 111, respectively. The angled sides, 183, of the protruding sections, 180 and 181, make it easier to subsequently fold along the lines, 170, 171, and 161. In addition, the angled sides, 186, of the sides of the protruding sections, 180 and 181, that are nearest to the bottom side edges, 120 and 121, respectively, of the quadrilateral sides, 110, and 111, respectively, are set back approximately half an inch from the bottom side edges, 120 and 121, respectively. This facilitates placing along the bottom edges, 120 and 121, an encasing layer, 122 and 123, of a rubbery material. It should be noted that while the encasing layers, 122 and 123, are illustrated in FIG. 2, these encasing layers are typically not rendered until all heat forming processes have been completed.

Figure 4:
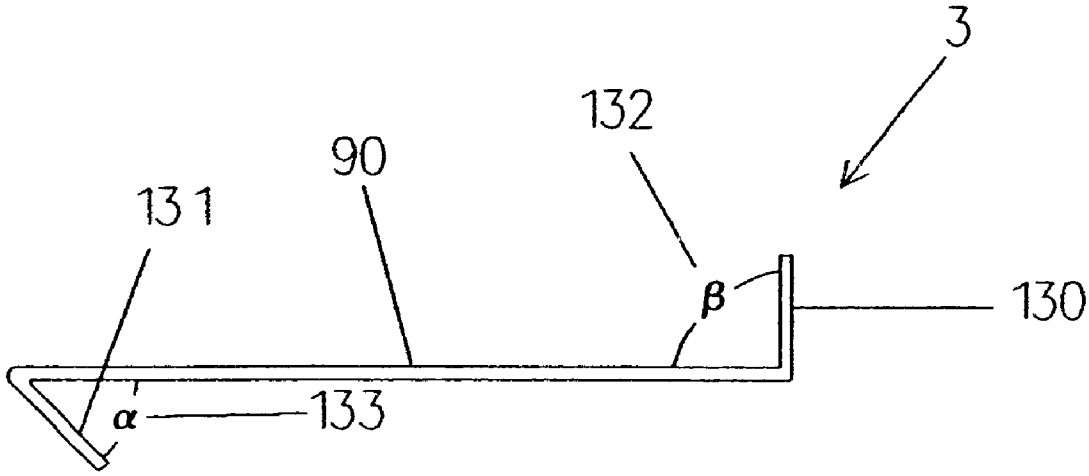
FIG. 4 is a side view of a sheet of material used to form a first preferred embodiment

Referring again to FIG. 2, the computer document holder quadrilateral sides, 110 and 111, are formed by applying heat along the edges, 170 and 171, respectively, and then folding the sides, 110 and 111, downward with respect to FIG. 2, to form approximately a 90 degree angle with the rectangular viewing surface, 90. The protruding section to be formed into the front top flange, 130, is formed by applying heat along the edge, 160, and then folding upward with respect to FIG. 2, to form approximately a 90 degree angle with the rectangular viewing surface, 90. The protruding section to be formed into the rear bottom flange, 131, is formed by applying heat along the edge, 161, and then folding downward with respect to FIG. 2. The angle formed by the rear bottom flange, 131, and the rectangular viewing surface, 90, is illustrated by FIG. 4, a side view of the single, sized sheet of thermoplastic material, 3, rendered to form the document holder. FIG. 4, illustrates only the folds used to form the front top flange, 130, and the rear bottom flange, 131. Referring to FIG. 2, folds along the dashed lines, 140, 141, 170 and 171, are not illustrated in FIG. 4. Continuing to refer to FIG. 4, the angle, alpha, 133, between the under side of the viewing surface, 90, and the rear bottom flange, 131, is approximately 45 degrees. As a result, when the document holder is standing, the rear bottom flange is at approximately a 90 degree angle with respect to a work surface. Continuing to refer to FIG. 4, the angle, beta, 132, between the viewing surface, 90, and the front flange, 130, is approximately 90 degrees. This serves to prevent documents from sliding off the document holder. To facilitate keeping books open, the angle, beta, 132, can alternatively be decreased to slightly less than 90 degrees. The front top flange, 130, then tends to exert a slight downward force on the upper pages of some books.

Regarding the method of heat forming, heat can be applied to thermoplastic sheets in various ways, including but not limited to: a) placing the entire sheet in an oven, b) the use of commercially available electric heating strips, which can be placed in contact with the material, c) the use of commercially available electric resistance heating rods, which can be used to radiate heat energy onto the material, and d) the use of a heat conducting fluid, such as glycol, circulated through square metal tubes situated above and below the material. Heat forming by additional processes, injection molding and transfer molding, will be considered with respect to a third preferred embodiment.

The method of heat forming is integral to the optimal practice of the present invention, especially for low start-up production volumes, but also as a manufacturing technique suitable for developing countries. In determining the preferred method for heating the material used to render the present invention, method d) of the preceding paragraph has been found to be most advantageous. One consideration in arriving at this conclusion is the need to avoid crazing, a formation of small cracks within thermoplastic materials, that can occur when the material is overheated, and/or cooled too quickly. When crazing occurs, thermoplastic materials become more brittle, and more subject to cracking. The use of circulating fluid is preferable to electric heating strips, and electric resistance heating rods, because the temperature of the fluid can be controlled quite precisely. As an example, for acrylic, a suitable procedure is to raise the temperature of the material along the edge to be formed to approximately 310 degrees F. When material to be formed is brought up to, but not above, the optimal temperature for the material used, crazing is less likely to occur. In addition, the material can remain at the optimal temperature for a short time, while those who do the assembly are carrying out other tasks. In other words, the assembler doesn't have to wait, and watch the material, to ensure heat from a strip heater or an electric resistance heating rod is applied for exactly the amount of time required to achieve the desired temperature. This is an important cost control and quality control aspect of the manufacturing process for first preferred embodiment of the present invention. Once the material has been removed from the heating device, and formed, it can be maintained in a frame, or jig, optionally having insulation suitable to ensure that it cools gradually, again, to minimize the danger of crazing.

Figure 5A:
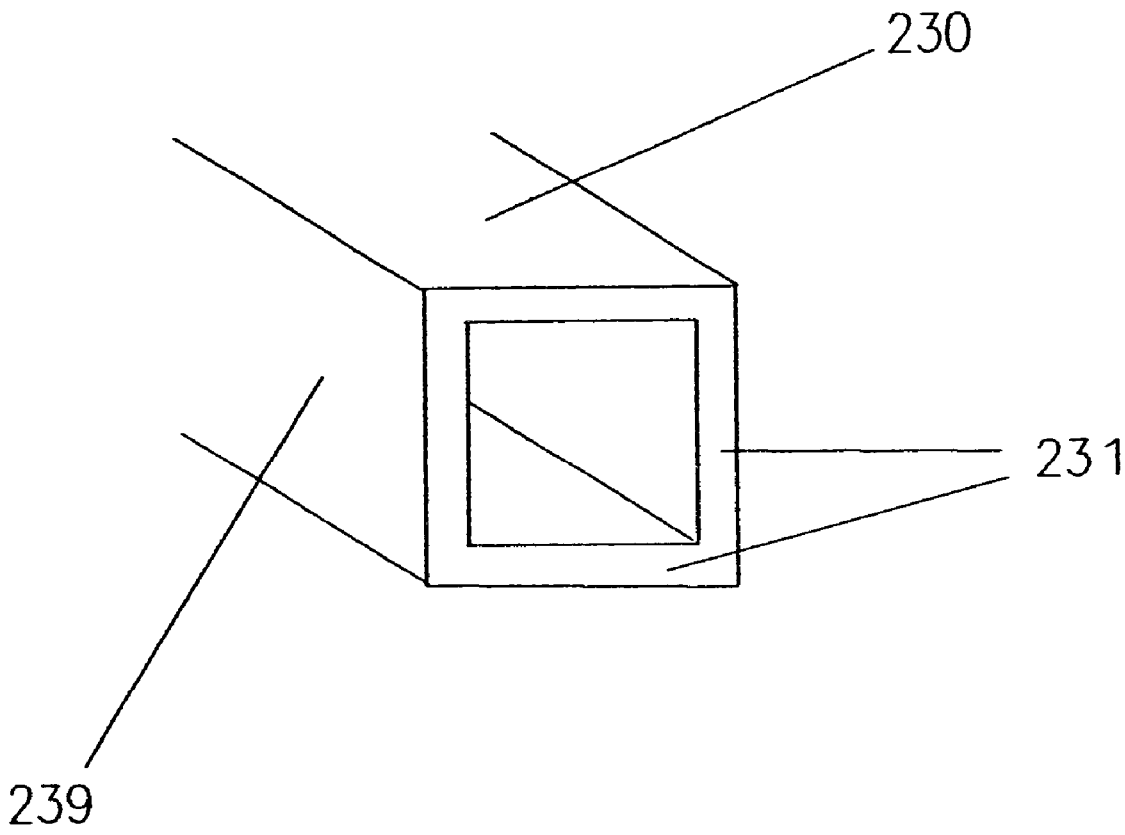
FIG. 5*a* is a top side perspective of a square metal tube section used for heat forming

FIG. 5*a* shows a perspective view of a section of square cross-section, hollow, metal tube material, 230. This will be referred to as: "square metal tube". Sections of square metal tube are comprised of four outer walls, 231, each at 90 degree angles to the adjacent walls. When hot fluid flows through the square metal tube, and a flat outer surface, 239, of one of these walls of a section of square metal tube comes into contact, or very close proximity, to thermoplastic material, heat is transferred to the thermoplastic material evenly over the area of contact between the square metal tube surface and the thermoplastic material.

Figure 5B:
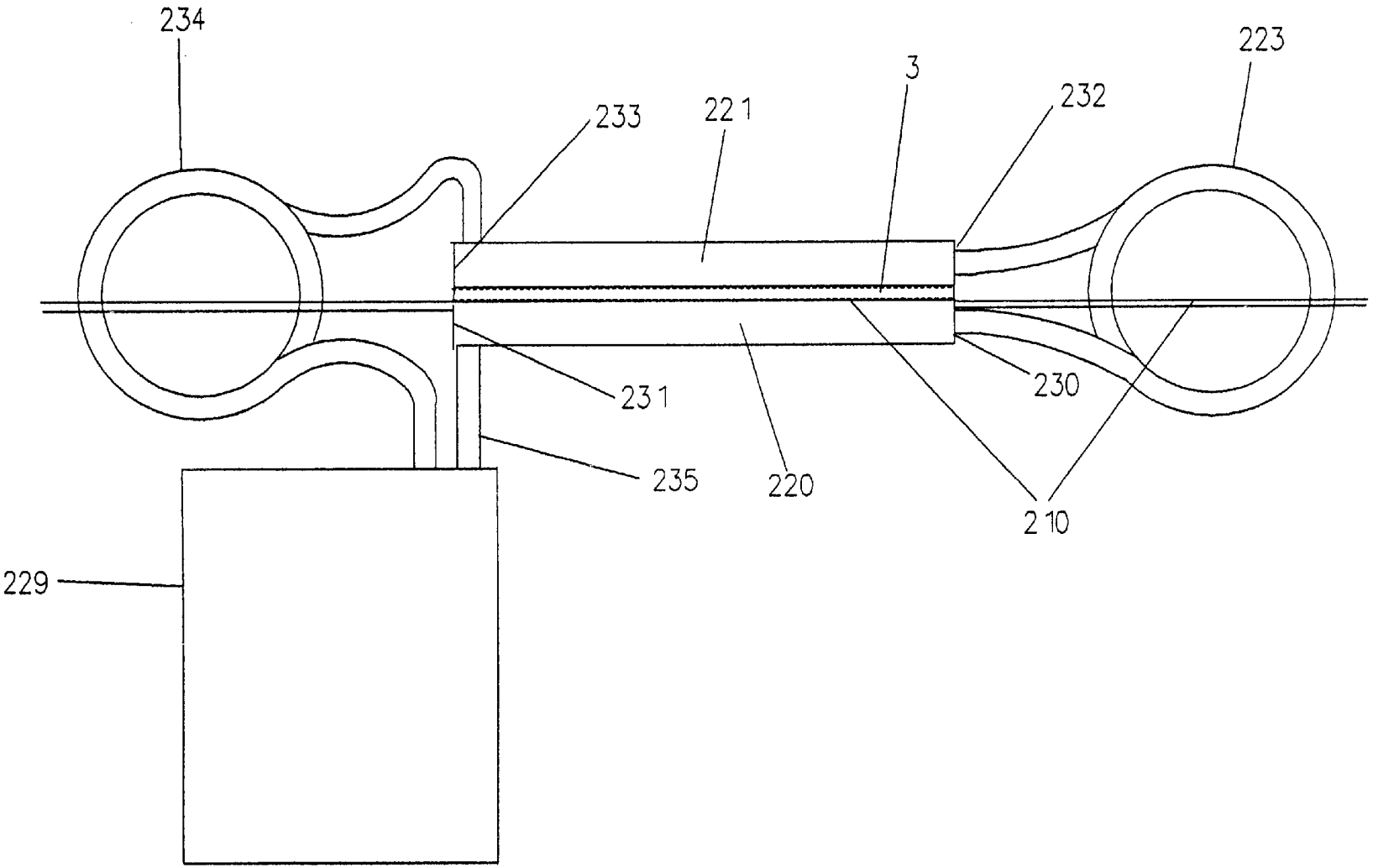
FIG. 5*b* is a side schematic view of a device used for heat forming

FIG. 5*b* illustrates a side view of a simple schematic arrangement, not drawn to scale, for heating thermoplastic material such that the flanges and folded edges of the document holder of the present invention can be formed. The sheet of material to be formed, 3, is placed on a work surface, 210. On the plane of the work surface, 210, there is a lower square metal tube section, 220, having two ends, 230 and 231. Immediately above and parallel to the lower square metal tube section, 220, there is an upper square metal tube section, 221, having two ends, 232 and 233. A first looped length of copper tubing, 223, connects one end of the lower square metal tube section, 230, to one end of the upper square metal tube section, 232. A second looped length of copper tubing, 234, connects the top of the second end, 233, of the upper square metal tube section, 221, with a combination heat source and pump, 229. Details of the combination heat source and pump, 229, are not illustrated. A short length of copper tubing, 235, is used to connect the bottom of the second end, 231, of the lower square metal tube section, 220, to the combination heat source and pump, 229. Thus, a fluid circuit is formed by the sections of copper and of square metal tube, and the combination heat source and pump. A heat transfer fluid, such as glycol, is circulated through this fluid circuit by the combination heat source and pump, 229. As the heat transfer fluid circulates, heat is transferred to the sheet of thermoplastic material, 3, from the lower surface of the upper square metal tube section, 221, and from the upper surface of the lower square metal tube section, 220. In this way, the temperature of the thermoplastic material is raised to a temperature suitable for heat forming, for an area on the sheet of thermoplastic material, 3, defined by the dimensions of the lower and upper square metal tube sections 220 and 221. It is important that the combination heat source and pump, 229, should both regulate the fluid temperature at the optimal temperature, and should maintain a fluid flow rate rapid enough to ensure that the entire length of the circuit is maintained at approximately the same temperature, even as heat is transferred to the thermoplastic material. Although no insulation is illustrated in FIG. 5*b*, or elsewhere, it should be understood that the entirety of the surface of the sections identified with respect to FIG. 5*b* that comprise the fluid circuit, together with the entirety of the surface of the heat source and pump, 229, are well insulated, except for the surfaces of the sections of square metal tube that transfer heat to the thermoplastic material.

Figure 5C:
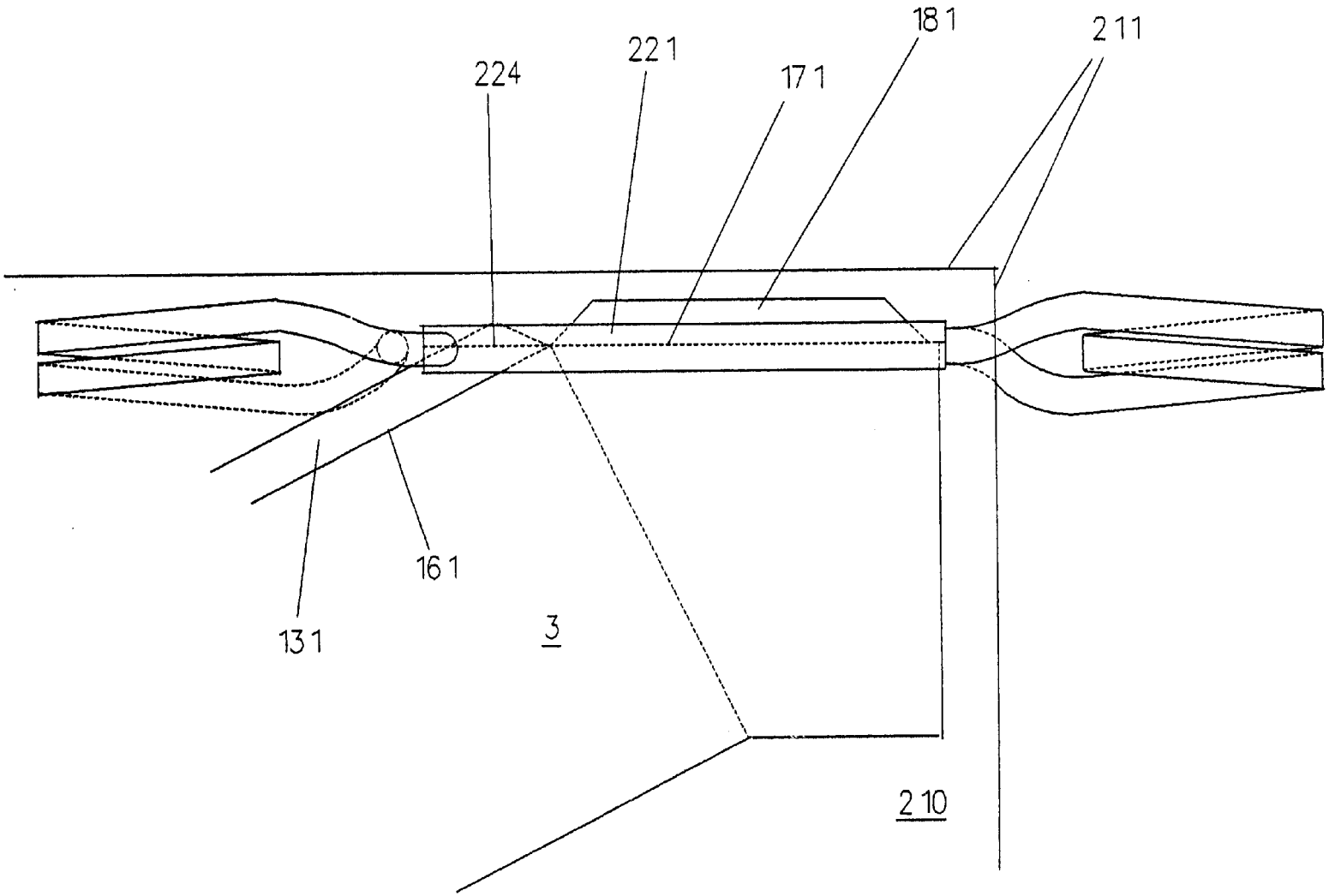
FIG. 5*c* is a top schematic view of a device used for heat forming

FIG. 5*c* illustrates a top view of the schematic arrangement of FIG. 5*b*. Referring to FIG. 5*c*, a sheet of thermoplastic material, 3, is on a work surface, 210, having work surface edges, 211. The thermoplastic material, 3, is to be folded along a dashed line, 171, indicated on the sheet of thermoplastic material, 3, and also indicated in FIG. 2. Referring again to FIG. 5*c*, the dashed line, 171, is aligned with a center line, 224, that runs along the full length of the bottom surface of the upper square metal tube section, 221, that will be in contact with the material. The lower square metal tube section is not illustrated in FIG. 5*c*, because it is aligned directly beneath the upper square metal tube section. The thermoplastic material is placed in the position illustrated in FIG. 5*c*, while heat transfer fluid runs through the fluid circuit, as previously described, until the material in the region between the upper and lower square metal tube sections has reached an optimal temperature for forming. The protruding section, 181, can then be slid along the work surface, 210, out from its position between the lower and upper square metal tube sections, so that the protruding section, 181, can be folded along the dashed line, 171.

Figure 5D:
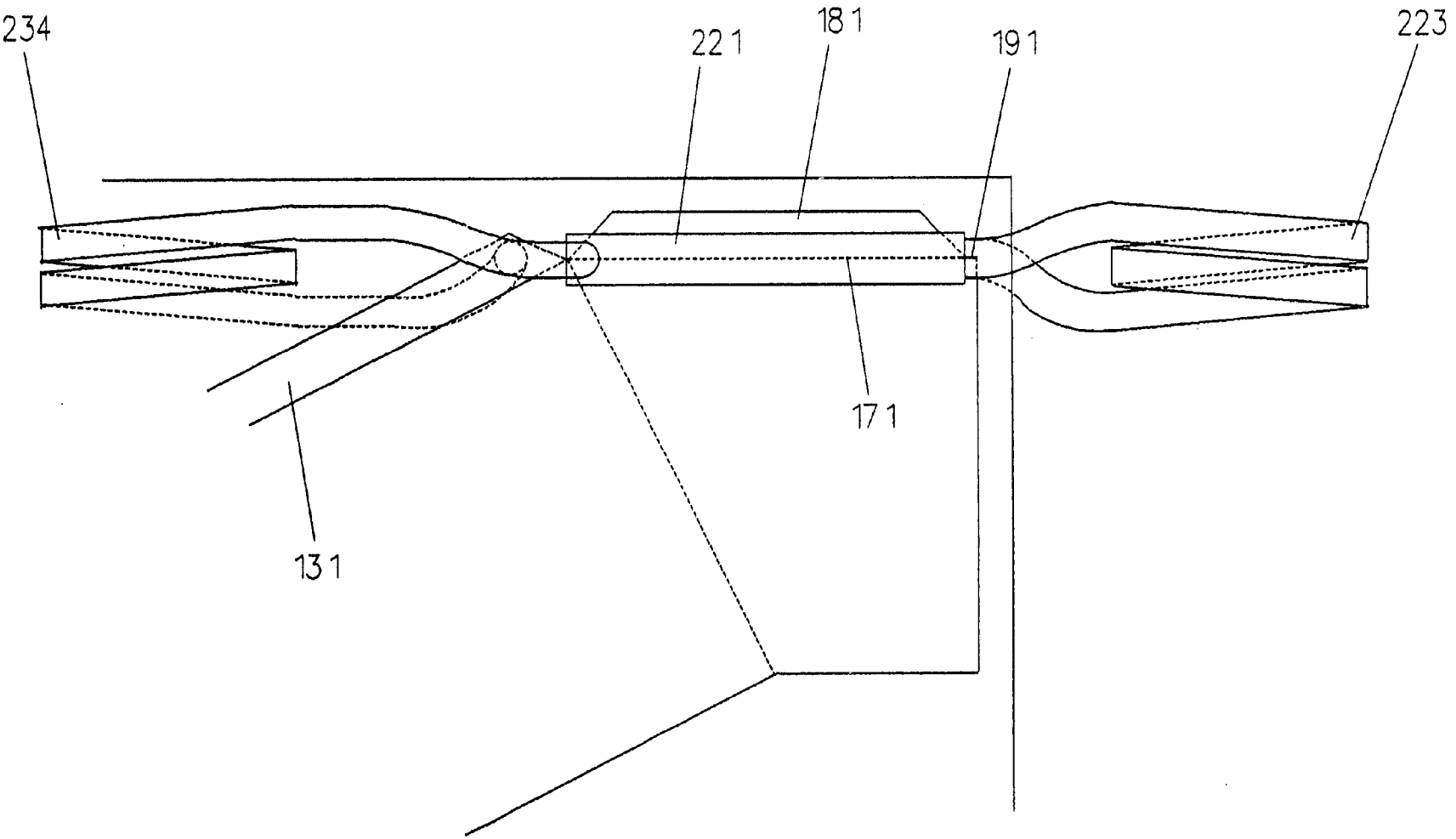
FIG. 5*d* is a top schematic view of a device used for heat forming

Continuing to refer to FIG. 5*c*, it should be noted that one result of the process described above is that part of another protruding section will also be heated unnecessarily, and may inadvertently become slightly bent as the protruding section, 181, is folded along the dashed line, 171. FIG. 5*d* illustrates a more optimal schematic arrangement, where the lengths of the upper and lower square metal tube sections, of which only the upper section, 221, is shown, are sized to correspond with the length of the dashed line, 171, along which the material is to be folded. As shown by the schematic of FIG. 5*d*, heat is only applied directly from the surfaces of square metal tube to the thermoplastic material along the area adjacent to the dashed line, 171, being heated to fold the section, 181. This avoids unnecessary heating and cooling of the material, and possibly unintended bending of the protruding section, 131. This may also serve to minimize the danger of crazing.

Figure 5E:
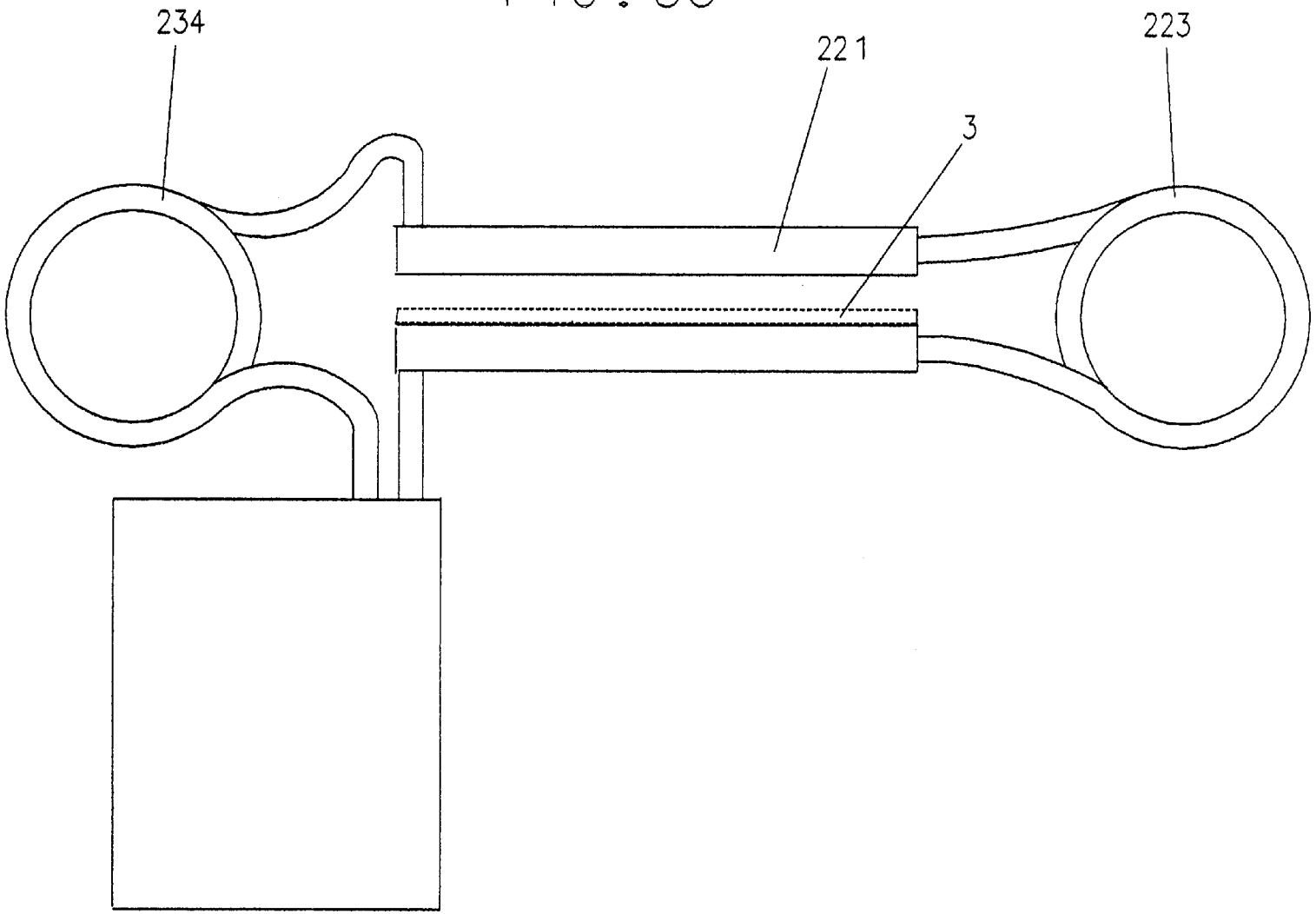
FIG. 5*e* is a side schematic view of a device used for heat forming

FIG. 5*e* illustrates a side view almost identical to the side view of FIG. 5*b*. FIG. 5*e* illustrates one variation with respect to FIG. 5*b*, referring again to FIG. 5*e*, the upper square metal tube section, 221, is raised slightly, allowing a sheet of material, 3, to be slid in and out more easily. The flexibility of the copper tube structures, 223 and 234, as seen also in FIG. 5*d*, now referring again to FIG. 5*e*, allows this slight movement of the upper square metal tube section, 221.

Figure 5F:
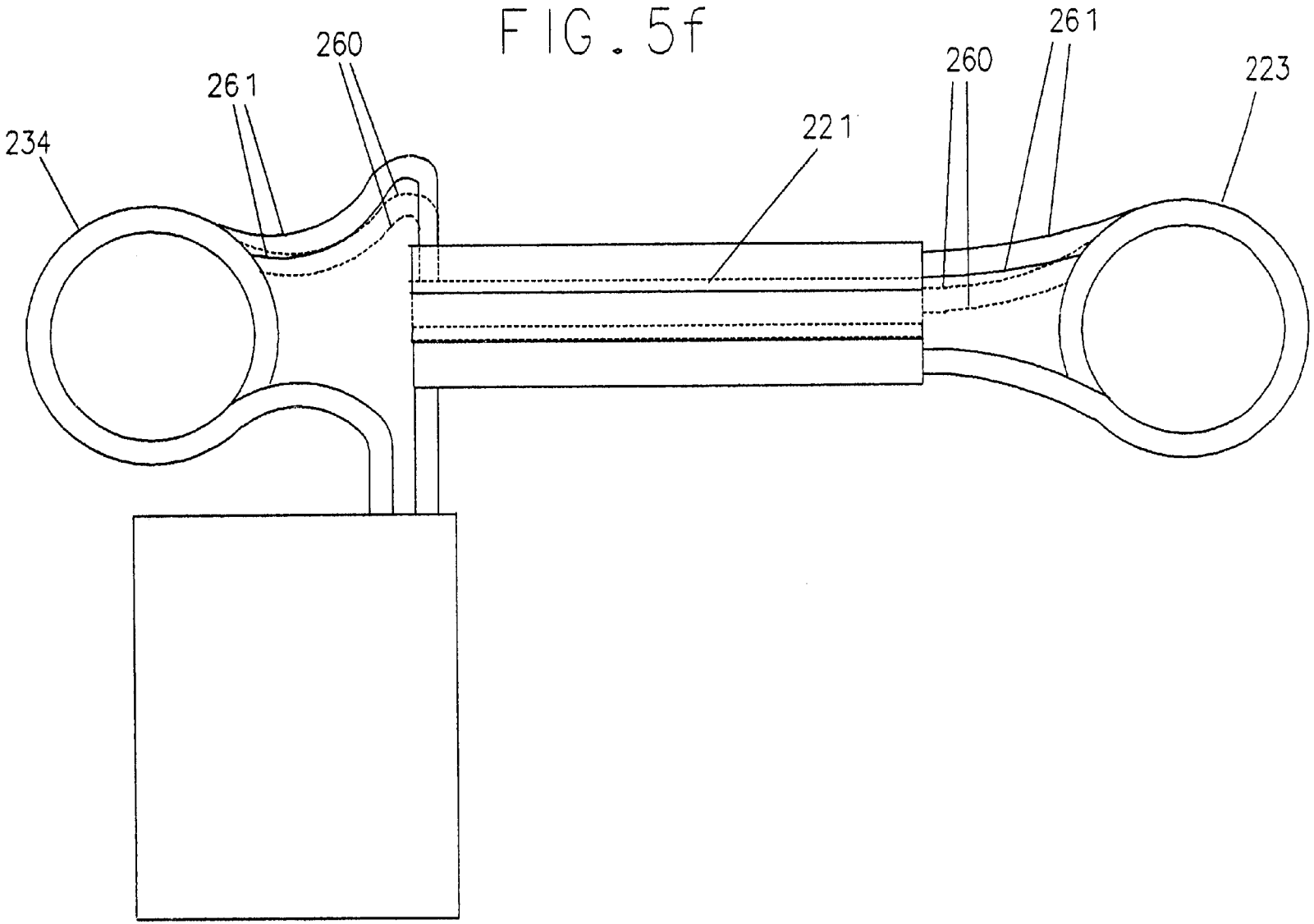
FIG. 5*f* is a side schematic view of a device used for heat forming

FIG. 5*f* is a slight variation on FIG. 5*e*, having dashed lines, 260, to indicate the position of portions of the sections of copper tube, 234 and 223, when the upper square metal tube section, 221, is in a lowered position, and having solid lines, 261, to indicate the position of portions of the sections of copper tube, 234 and 223, when the upper square metal tube section, 221, is in a raised position.

Referring again to FIG. 5*e*, although the use of insulation material is not illustrated, raising and lowering the upper section of square metal tube, 221, facilitates the use of attached insulation material and insulation support structure along the sides of the upper section of square metal tube, 221. When the upper section of square metal tube, 221, is raised slightly, the insulating material and insulation support structure are also raised. When no sheet of material is in place to be heat formed, and when the upper section of square metal tube, 221, is lowered, the insulating material and insulation support structure can be designed such that insulating material sags enough to come into contact with the work surface, 210, of FIG. 5*b*. Referring to FIG. 5*c*, the area of the work surface, 210, adjacent to the square metal tube sections, (only the upper square metal tube section is shown), should be of a poor heat conducting material, such as glass, to minimize heat dissipation. Thus, a device such as one illustrated by the schematic of FIG. 5*b* through FIG. 5*f* can be left on, with heat transfer fluid continuing to flow, during intervals when it is not in use, with a minimal amount of heat dissipation, but ready to use immediately when needed.

Figure 6:
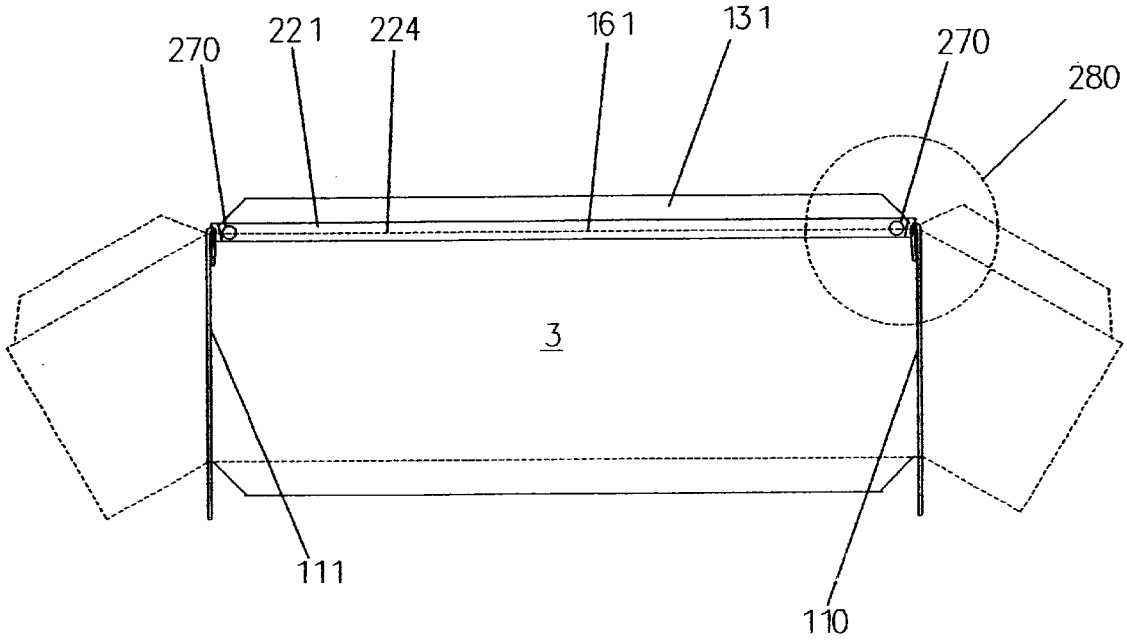
FIG. 6 is a bottom view of a sheet of material, and schematic components of a heat forming device
Figure 6A:
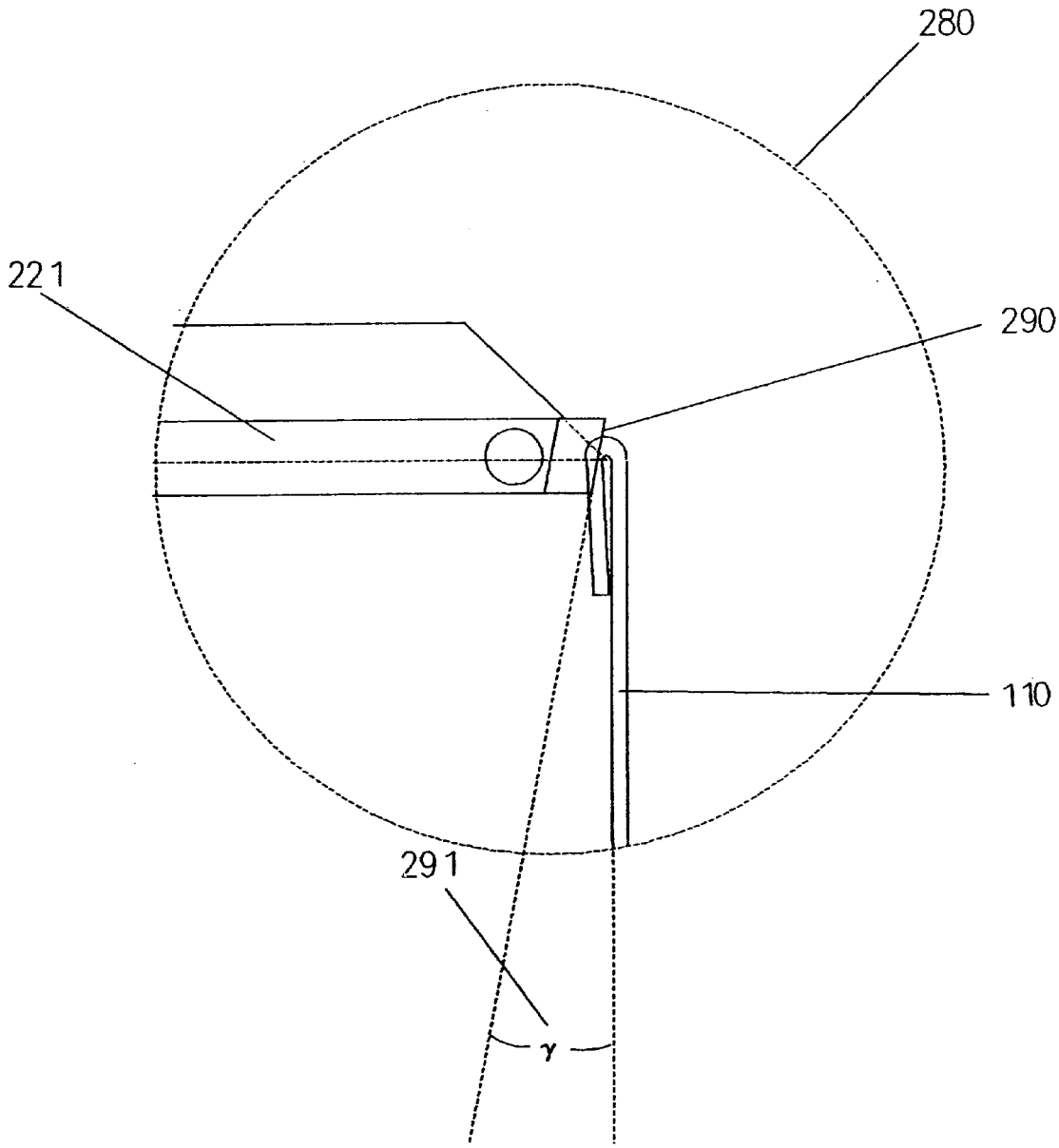
FIG. 6*a* is a bottom view of a detail area of a sheet of material, and schematic components of a heat forming device
Figure 6B:
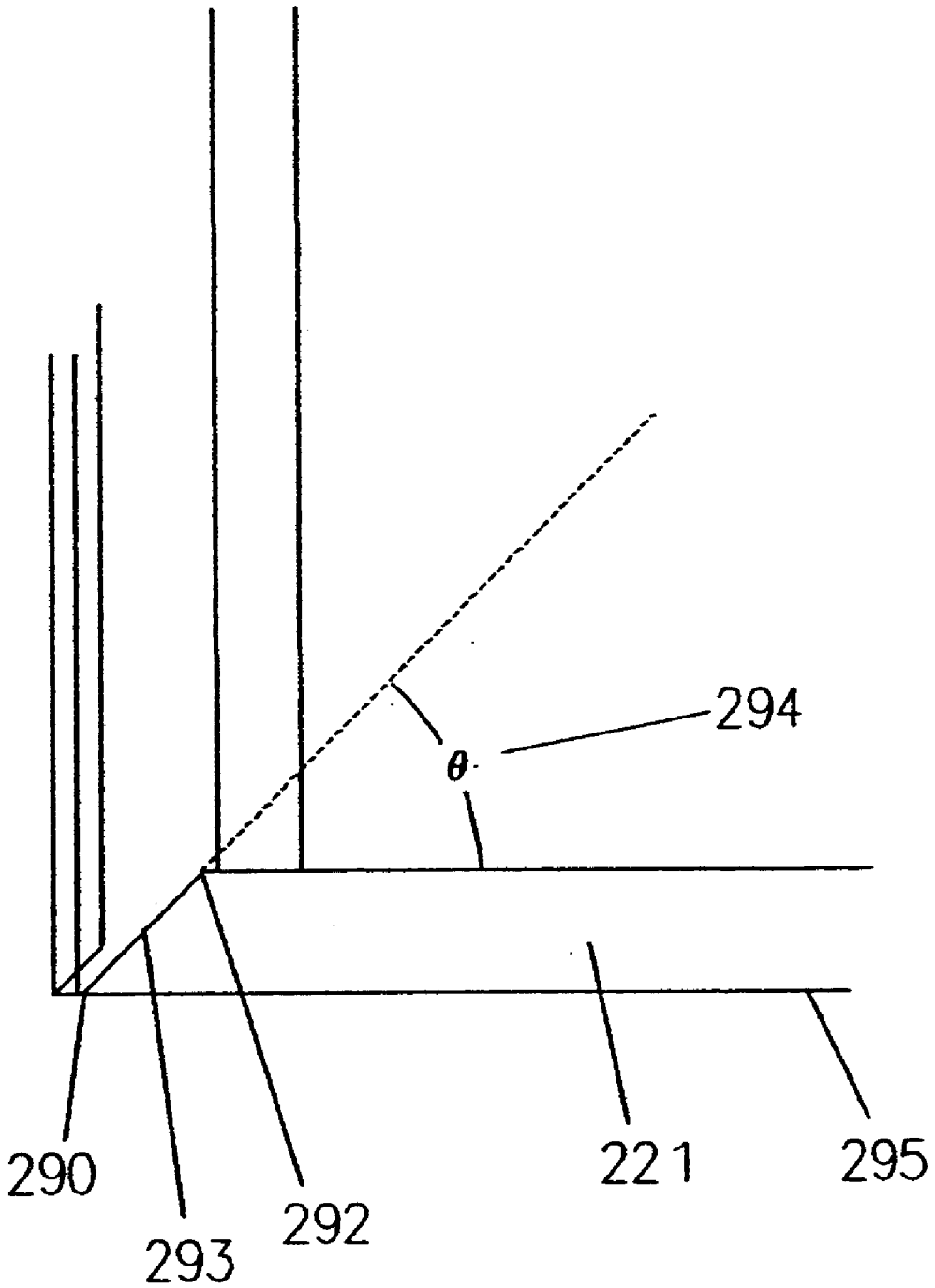
FIG. 6*b* is a side view of a detail area of a sheet of material, and schematic components of a heat forming device

FIG. 6 through FIG. 6*b* illustrate another way in which the shape of sections of square metal tube can be customized to further optimize the production process. FIG. 6 is a bottom view of a sheet of thermoplastic material, 3, also schematically illustrating an upper section of square metal tube, 221, which functions as previously described with an opposing, parallel, lower section of square metal tube, (not illustrated). The upper section of square metal tube, 221, has attached at the top of each end, a section of copper tube, 270. These sections of copper tube, 270, together with the upper section of square metal tube, 221, and the lower section of square metal tube, not shown, and a combination heat source and pump, not shown, complete a fluid circuit, and function along the lines of the heat forming process described previously. Continuing to refer to FIG. 6, the line 161, representing the folding line for the rear bottom flange section, 131, of the thermoplastic sheet, 3, is aligned with a center line, 224, that runs along the full length of the bottom surface of the upper square metal tube section, 221, that will be in contact with the thermoplastic material. As will be explained further, the size and shape of the upper hollow, metal tube section, 221, is such that when fluid moves through the fluid circuit, heat is to be transferred only to the surface of the material immediately adjacent to the line 161, representing the folding line for the rear bottom flange section, 131. Referring again to FIG. 6, the side sections, 110 and 111, are shown in dashed outline in the position they occupied before being heat formed, as can also be seen by comparison with the symmetrical top view of FIG. 2, and, referring again to the bottom view of FIG. 6, with solid lines in their formed position, facing directly upward from the plane of FIG. 6.

FIG. 6*a* is an enlarged bottom view of the dashed circle area, 280, of FIG. 6. FIG. 6*a* discloses that the terminus, 290, of the lower surface edge of the end of the section of square metal tube, 221, is at an angle, gamma, 291, with respect to the plane of the document holder side, 110. FIG. 6*b* is a side view of the same region of FIG. 6 that is shown in FIG. 6*a*. Referring to FIG. 6*b*, the line, 293, from the terminus, 290, of the lower surface edge of the end of the section of square metal tube, 221, to the terminus, 292, of the upper surface edge of the end of the section of square metal tube, 221, is at an angle, theta, 294, with respect to the lower surface of the section of square metal tube, 295. It should be noted that as fluid flows through the fluid circuit, turbulence results in a continuing flow of fluid into the terminus of the lower surface edge of the end of the square metal tube, 290, of FIG. 6*a* and FIG. 6*b*.

One advantage of the design for the end of the section of square metal tube described above with reference to FIG. 6 through FIG. 6*b* is similar to an advantage of the schematic presented in FIG. 5*d*: to minimize the transfer of heat anywhere other than to the surface of the material immediately adjacent to the line representing a folding line for the thermoplastic material.

Second Preferred Embodiment

Figure 7:
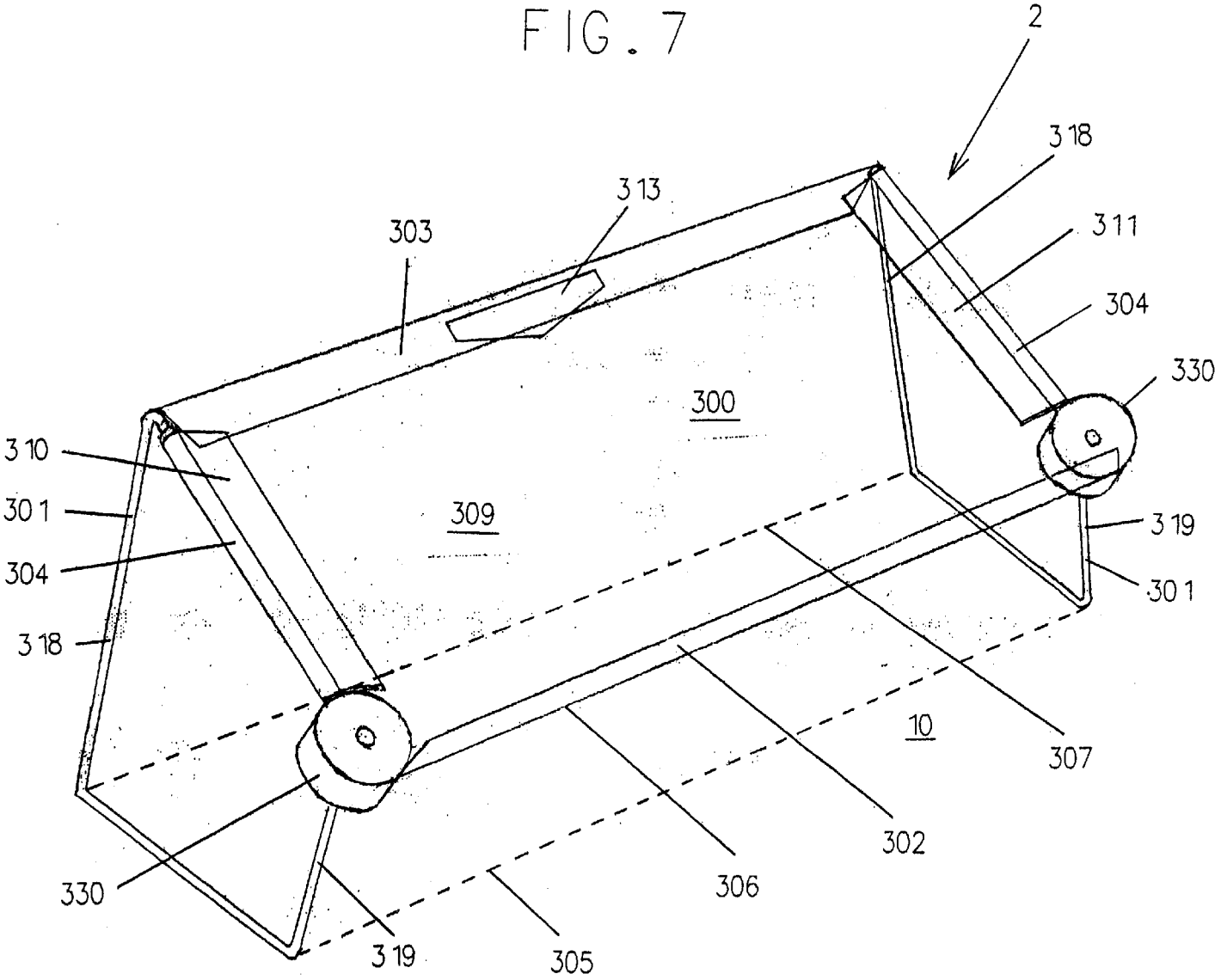
FIG. 7 is a top side perspective of a second preferred embodiment

Because the second preferred embodiment is equivalent in many ways to the first preferred embodiment, equivalences will be noted with reference to the first preferred embodiment, rather than described in detail. FIG. 7 illustrates a second preferred embodiment of a free-standing computer document holder, 2, of the present invention, viewed from a perspective similar to the perspective of FIG. 1. Although FIG. 7 does not illustrate all the elements of FIG. 1, the use of the second preferred embodiment is equivalent to the use of the first preferred embodiment. As with the first preferred embodiment, the computer document holder of the second preferred embodiment is also free-standing, to allow maximum freedom and convenience for the computer user, and specifically to allow the computer user to operate a keyboard, and/or a mouse, while the document holder is situated in a variety of positions, including in front of, and/or over, and/or behind, the keyboard. The computer document holder, 2, of FIG. 7, is portable, and is comprised of a sized sheet of thermoplastic material, 300, left and right leg securing devices, 330, left and right folding quadrilateral leg structures, 301, made of metal rod, or any similar durable, rigid, formable material, formed into a closed quadrilateral shape, and in a deployed position resting on a work surface, 10. The two leg securing devices, 330, are mirror image devices, and are not interchangeable. The sheet of thermoplastic material, 300, is formed in a way equivalent in several respects to the first preferred embodiment of FIG. 1. Referring to FIG. 7, the computer document holder, 2, has a rectangular viewing surface, 309, with a structure and function equivalent to the rectangular viewing surface, 90, of FIG. 1, and, referring again to FIG. 7, supported by the left and right quadrilateral leg structures, 301. Referring to FIG. 7, it can be seen that the rear sides, 318, of the quadrilateral leg structures, 301, are longer than the front sides, 319, of the quadrilateral leg structures, 301, such that when the quadrilateral leg structures, 301, are in a deployed position, the top of a document on the rectangular viewing surface, 309, is elevated above the bottom of the document, with respect to the work surface, 10. Continuing to refer to FIG. 7, the computer document holder, 2, has a front top flange, 302, that has a structure and function equivalent to the front top flange, 130, of FIG. 1. Referring again to FIG. 7, the document holder, 2, has a rear bottom flange, 303, that has a structure and function equivalent to the rear bottom flange, 131, of FIG. 1. Referring again to FIG. 7, the quadrilateral leg structures, 301, are enclosed first in tubes, 304, and these tubes, 304, are then encased in thermoformed, folded sections, 310 and 311, of the sheet of thermoplastic material, 300. The leg securing devices, 330, hold the quadrilateral leg structures, 301, in slightly splayed positions, such that the length of the dashed line, 305, indicating the distance between the bottom front bends of the quadrilateral leg structures, 301, is slightly greater than the length, 306, of the sheet of thermoplastic material, 300, along the line where it is thermoformed to form the front flange, 302. As a geometric consequence of the quadrilateral shape and the slightly splayed positions of the quadrilateral leg structures, 301, the length of the dashed line, 307, indicating the distance between the bottom rear bends of the quadrilateral leg structures, 301, is greater than the length of the dashed line, 305, indicating the distance between the bottom front bends of the leg structures, 301.

Alternatively, the deployed positions of the leg structures, 301, can be such that, as with the first preferred embodiment, the plane of the quadrilateral leg structures, 301, is perpendicular to the plane of the rectangular viewing surface, 309, of the second preferred embodiment. For this alternative deployed position of the leg structures of the second preferred embodiment, the lines, 306, 305, and 307, of FIG. 7 would all be of equal length.

FIG. 7 also illustrates an optional section, 313, that is cut out of the thermoplastic material, 300, and functions as a simple, handle-sized gap for carrying the second preferred embodiment of the computer document holder. This optional cut out section, 313, is also illustrated in FIG. 7*a*, but is omitted from the other drawings.

Figure 7A:
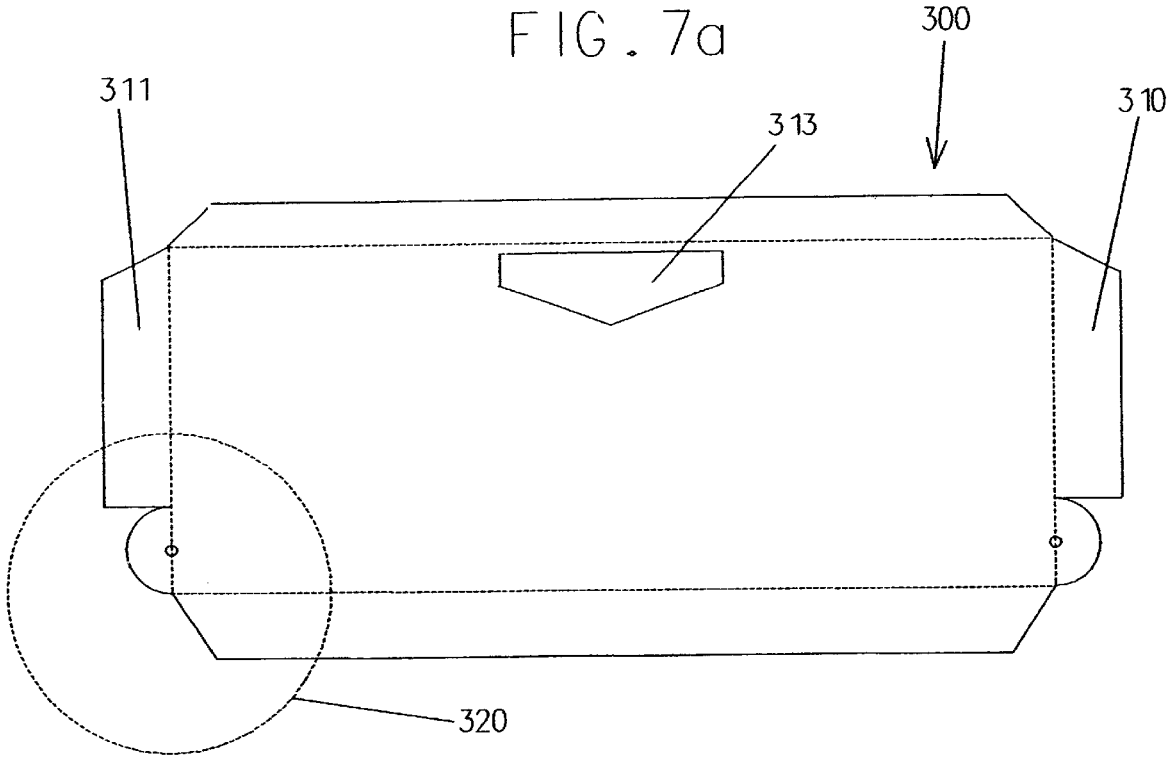
FIG. 7*a* is a bottom view of a second preferred embodiment sheet of material

FIG. 7*a* illustrates a bottom view of a sheet of thermoplastic material, 300, used to form a second preferred embodiment of the present invention. With the exception of the side sections, 310 and 311, the sheet, 300, of FIG. 7*a* is very similar to the sheet, 3, of FIG. 2. The dashed circle area, 320, is detailed in other figures representing enlarged views.

FIG. 8*a*, FIG. 8*b*, and FIG. 8*c* illustrate a leg securing device, 330, that is used to position the quadrilateral leg structures of the second preferred embodiment. FIG. 8*a* and FIG. 8*b* are top and bottom views, respectively, relative to a top view of the computer document holder in use. FIG. 8*a* illustrates the outer dimension of the leg securing device, 330, comprising a cylindrical section, having a circular perimeter with a diameter of approximately two inches. Although the depth of the leg securing device, 330, is drawn to scale in FIG. 8*c*, as one inch, it should be noted that the depth of the leg securing device, 330, can be varied, and can be less than one inch. Continuing to refer to FIG. 8*c*, the device, 330, is seen in side view, and comprises a single, formed piece of rubbery material, such that it deforms only slightly when a moderate pressure is applied to an area of the surface of the material. Continuing to refer to FIG. 8*c*, the leg securing device, 330, comprises a first section, 341, which appears in FIG. 8*c* as an upper rectangle. The first section, 341, of FIG. 8*c* is continuous along the dashed line, 343, with a second section, 342, which appears in FIG. 8*c* as a lower rectangle. The depth of the first section, 341, as seen from the perspective of FIG. 8*c*, is approximately one fourth inch.

Referring to FIG. 8*a*, a first surface of the first section, 341, of FIG. 8*c*, can be seen, referring again to FIG. 8*a*, as the area, 350, enclosed by the demarcating polyline, 354, and the outer perimeter of the circle, 356. This first surface area, 350, is also exploded and illustrated in FIG. 8*d*. Regarding the second section, 342, of FIG. 8*c*, part of a second surface of the second section, 342, can be seen, referring again to FIG. 8*a*, as the area, 355, enclosed by the demarcating polyline, 354, and the outer perimeter of the circle, 356, interrupted by a gap, 357. This area, 355, is also exploded and illustrated in FIG. 8*d*. The first and second surfaces, 350 and 355, of FIG. 8*d*, respectively, comprise the inner side of the leg securing device, 330. As illustrated in FIG. 8*h* and FIG. 8*i*, the inner side of the leg securing device is attached to the underside of the sheet of thermoplastic material, 300, such that, referring again to FIG. 8*c*, the first surface, 350, will be in contact with the sheet of thermoplastic material, and the second surface, 355, will be recessed from the sheet of thermoplastic material.

FIG. 8*b* is a bottom view of the leg securing device, 330, illustrating a third surface, 360, that is also isolated and illustrated in FIG. 8*e*, and comprises the outer side of the leg securing device, 330.

A comparison of FIG. 8*a* and FIG. 8*b* discloses that at the outer perimeter of the quadrilateral leg securing device, 330, the gap, 357, is orthogonal to the third surface, 360, of FIG. 8*b*, and is orthogonal to the second surface, 355, of FIG. 8*a* FIG. 8*a* illustrates a first dashed circle, 370, at the second surface, 355, as also indicated in FIG. 8*d*. Referring again to FIG. 8*a*, the first dashed circle, 370, encircles a first inner terminus area of the gap, 371, such that the first dashed circle, 370, is, by visual inspection, slightly closer to the perimeter, 356, of the leg securing device, 330, than to the center, 331, of the leg securing device. FIG. 8*b* illustrates a second dashed circle, 372, at the third surface, 360, as also indicated in FIG. 8*e*. Referring again to FIG. 8*b*, the second dashed circle, 372, encircles a second inner terminus area of the gap, 373, such that the periphery of the second dashed circle, 372, overlaps the center, 331, of the leg securing device. Thus, referring to FIG. 8*b*, if a straight rod section of a quadrilateral leg structure, having a diameter of about one fourth inch, were to be placed within the leg securing device, 330, such that the said straight rod section were to pass through the first dashed circle, 370, on the second surface 355, the said second surface, 355, being part of the bottom side as shown in FIG. 8*b*, and the said straight rod section were to pass through the second dashed circle, 372, on the upper surface, 360, of FIG. 8*b*, the said straight rod section would not be at a 90 degree angle to the upper surface, 360, of FIG. 8*b*. Continuing to refer to FIG. 8*b*, structural consequences of the relative locations of the first dashed circle, 370, and the second dashed circle, 372, will be further disclosed.

FIG. 8*f* is a bottom view of the leg securing device, 330, similar to the bottom view of FIG. 8*a*, except that the leg securing device, 330, is rotated with respect to the perspective of FIG. 8*a* FIG. 8*g* is a side view of the leg securing device, 330, similar to the side view of FIG. 8*c*, except that FIG. 8*g* depicts the same rotation of the leg securing device, 330, that differentiates FIG. 8*f* with respect to FIG. 8*a* Referring to FIG. 8*g*, the gap, 357, is represented at the outer perimeter of the diameter of the leg securing device, 330, by the lines, 383, and 384. FIG. 8*g* illustrates what has already been indicated above: at the outer perimeter of the leg securing device, 330, the gap, 357, is orthogonal to both the second surface, 355, and the third surface, 360, of the leg securing device, 330.

Referring to FIG. 8*f* and FIG. 8*g*, the point, 391, of FIG. 8*f* illustrates a first side of the inner terminus end of the gap, 357, at the point of the third surface, 360, as shown in FIG. 8*g*. The dashed line, 359, between FIG. 8*f* and FIG. 8*g*, indicates the relationship between the location of the point, 391, as shown in FIG. 8*f*, and as shown in FIG. 8*g*. Referring to FIG. 8*f*, the point, 392, illustrates a first side of the inner terminus end of the gap, 357. The point, 392, of FIG. 8*f* is also situated in FIG. 8*g*, at the first side of the inner terminus end of the gap, 357, on the second surface, 355. The dashed line, 393, of FIG. 8*g*, illustrates that if a straight rod section of one of the quadrilateral leg structures were to be situated within the inner terminus end of the gap, 357, that is within the leg securing device, 330, the straight rod section would be at an angle, pi, 394, of approximately 45 degrees, with respect to the third surface, 360, and the first and second surfaces, 350 and 355, that are parallel to the third surface, 360.

FIG. 8*h* illustrates the leg securing device, 330, exactly as depicted in FIG. 8*g*, together with a straight rod section of a quadrilateral leg structure, 301, that is illustrated in FIG. 7, and, referring again to FIG. 8*g*, also together with the thermoplastic sheet, 300, of FIG. 7*a*. FIG. 8*g* illustrates that when the straight rod section of the leg structure, 301, is situated at the inner terminus of the gap, 357, within the leg securing device, 330, it is at the angle, pi, 394, with respect to the third surface, 360, and with respect to the other surfaces that are parallel to the third surface, 360. FIG. 8*h* also illustrates a cap, 395, with an inner, threaded area, 396, that is attached to the leg securing device, 330, by means of a protruding screw section, 352, that comprises part of a screw structure, 398, that is embedded within the rubbery material of the leg securing device, 330. The leg securing device, 330, is attached to the under side of the sheet of thermoplastic material, 300, by means of the cap, 395. The cap, 395, is circular, with a diameter corresponding to the diameter of the leg securing device, 330.

FIG. 8*i* is almost identical to FIG. 8*h*, except that the illustration has been rotated such that the straight rod section of the quadrilateral leg structure, 301, is approximately perpendicular to a work surface, 10. FIG. 8*i* illustrates that the leg securing device, 330, secures the straight rod section of the quadrilateral leg structure, 301, such that, referring now to FIG. 7, when the computer document holder, 2, is in use, with leg structures, 301, deployed, it functions in an equivalent way to the function of the first preferred embodiment, described previously with reference to FIG. 1.

Figure 8J:
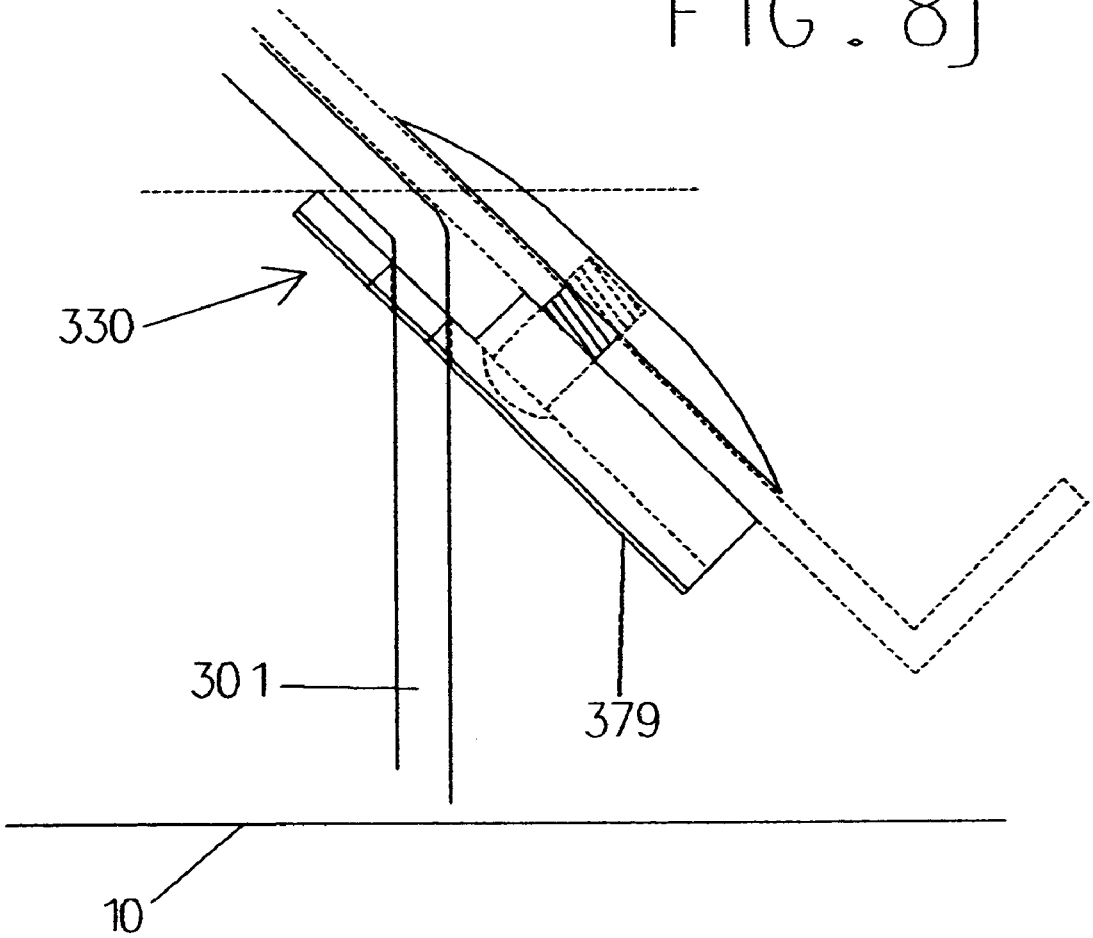
FIG. 8*j* is a side view of a second preferred embodiment leg securing device

FIG. 8*j* is almost identical to FIG. 8*i*, except that the thickness of the leg securing device, 330, has been reduced significantly, and a rigid, terminus reinforcing structure, 379, is shown as attached to the outer side of the leg securing device. This rigid, terminus reinforcing structure may be made of metal, or other similar rigid material, and is such that it stops the quadrilateral leg structure, 301, at the inner terminus of the gap in the leg securing device, 330.

It will be understood that while the second preferred embodiment comprises the leg securing device as detailed above, other means for a leg securing device can also be employed, having equivalent functionality with respect to securing the quadrilateral leg structures, 301, of FIG. 7, in a deployed position, and also allowing the quadrilateral leg structures, 301, of FIG. 7, to be secured in a retracted position, such that they would be adjacent to, and on the plane of, the under side of the rectangular viewing surface, 309, of FIG. 7.

Figure 9:
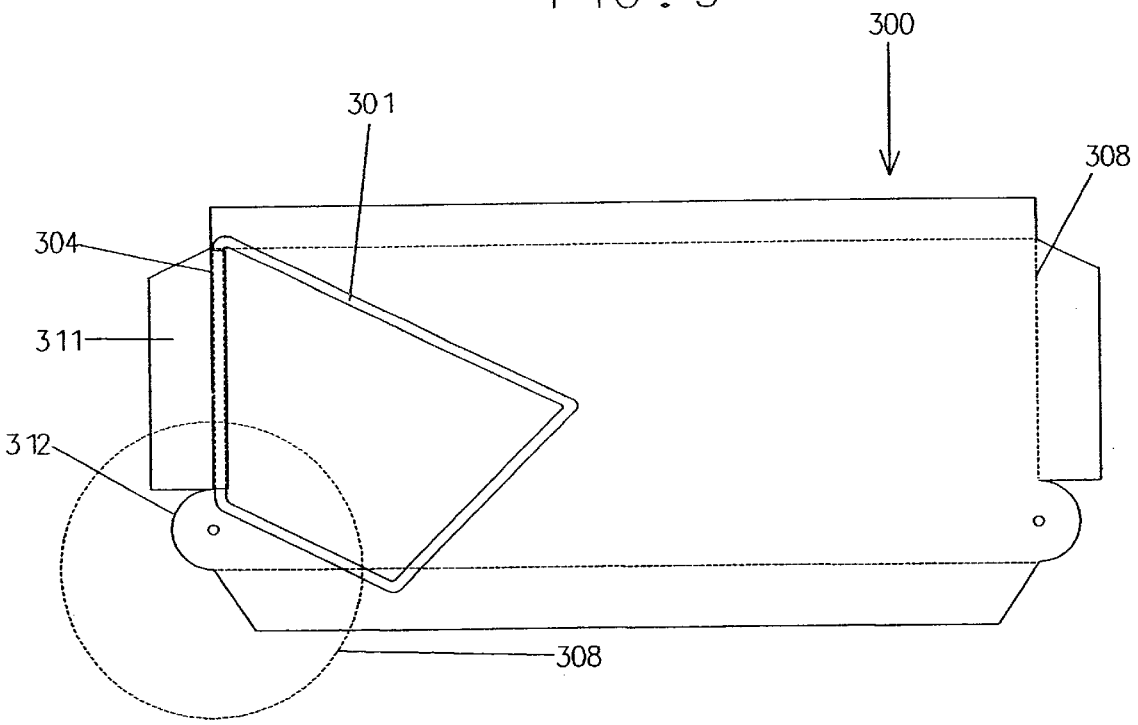
FIG. 9 is a bottom view of a second preferred embodiment sheet of material, with a quadrilateral leg structure

FIG. 9 illustrates a bottom view of the sheet of thermoplastic material, 300, and an attached upper side of a quadrilateral leg structure, 301, enclosed in a tube, 304, made of metal, or a similar rigid material, within which the upper side of the quadrilateral leg structure may rotate. The protruding section, 311 of the sheet of thermoplastic material, 300, is heated along a line corresponding to the dashed line, 308, at the opposite side, and is then folded over to encase the tube, 304, that, in turn, encloses the quadrilateral leg structure, 301. Because the entire length of the tube, 304, is encased in the thermoformed protruding section, 311, mechanical stress from the quadrilateral leg structure, 301, is transmitted by the tube, 304, throughout the length of the encasing thermoplastic material. This transfer of mechanical stress makes it more difficult to break the thermoplastic material. Although FIG. 9 illustrates only one side of the assembly of the leg structure, a mirror-image process is used for the other side. The dashed circle, 308, indicates an area that is enlarged and detailed in FIG. 10.

Figure 10:
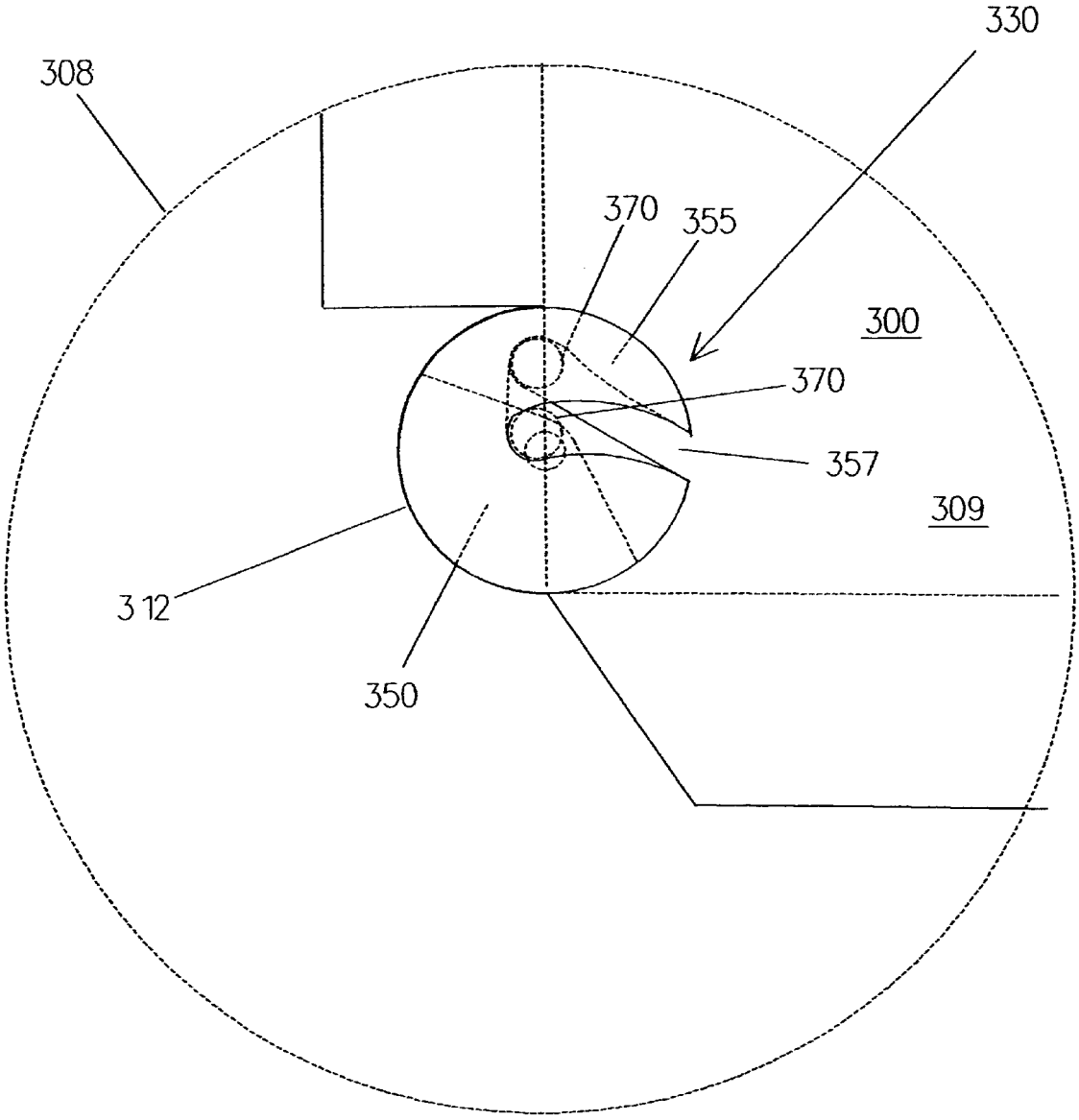
FIG. 10 is a bottom view of a detail area of a second preferred embodiment sheet of material, with a leg securing device

FIG. 10 illustrates the placement of a leg securing device, 330, on a lower corner of the under side of the rectangular viewing surface, 309, of the sheet of thermoplastic material, 300. Referring to FIG. 9, it can be seen that there is a semi-circular section, 312, that is sized to correspond to the diameter of the leg securing device, 330, of FIG. 10. Referring to FIG. 8*a*, the first surface, 350, now referring to FIG. 10, is seen as on the underside of the leg securing device, 330. Continuing to refer to FIG. 10, the first surface, 350, and part of the bottom of the leg securing device, 330, are in contact with the sheet of thermoplastic material, 300. Referring to FIG. 8*a*, the second surface, 355, now referring to FIG. 10, is also seen as on the underside of the leg securing device, 330. Continuing to refer to FIG. 10, because the first surface, 350, is in contact with the sheet of thermoplastic material, 300, now referring to FIG. 8*a*, it can be seen that the second surface, 355, now referring again to FIG. 10, is at a distance of about ¼ inch from the surface of the sheet of thermoplastic material, 300. Referring to FIG. 10, the gap, 357, is continuous from the outer circumferential terminus, to the inner terminus, indicated by the dashed circles, 370 and 372, thus allowing a leg structure to move between the retracted and the deployed position.

FIG. 11 illustrates the same bottom view of FIG. 10, and is similar to FIG. 10, with the addition of other elements illustrated in FIG. 7, including, referring again to FIG. 11, part of a quadrilateral leg structure, 301, enclosed in a tube, 304, which in turn is encased in the folded protruding section, 311, of the sheet of thermoplastic material, 300, such that the surface of the folded, protruding section, 311, is brought into contact with the under side of the rectangular viewing surface of the sheet of thermoplastic material, 300. In this way, the quadrilateral leg structure, 301, and tube, 304, are attached to the sheet of thermoplastic material, 300. The quadrilateral leg structure, 301, is illustrated by the solid lines in a deployed position, and is also illustrated by dashed lines, 320 and 321, as it would be in a retracted position. In the deployed position, the quadrilateral leg structure, 301, is in a slightly splayed position, and is stopped from becoming further splayed by the terminus, 399, of the gap, 357, in the leg securing device, 330, of FIG. 11.

Figure 11:
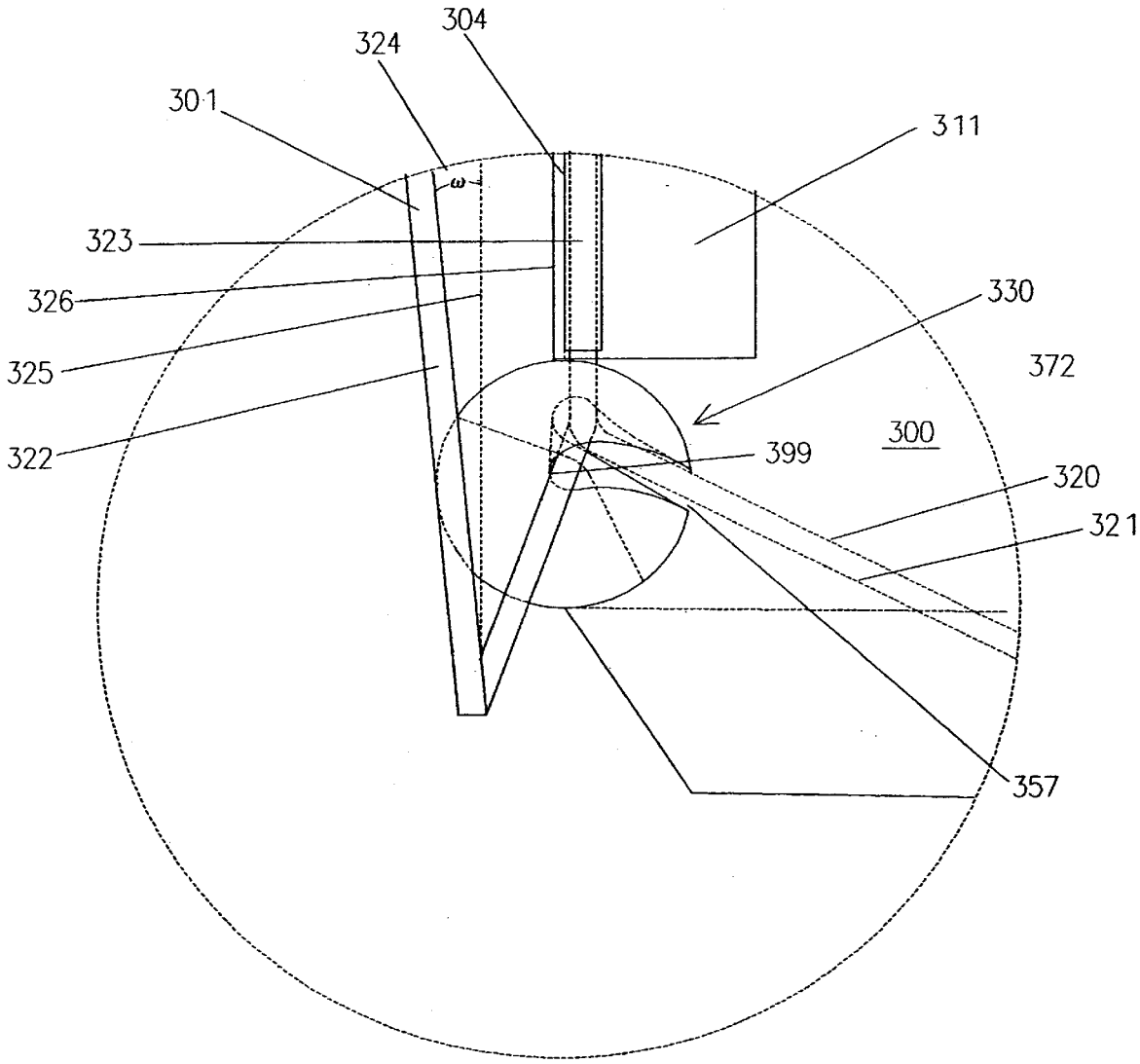
FIG. 11 is a bottom view of a detail area of a second preferred embodiment sheet of material, with a leg securing device and with a quadrilateral leg structure

As seen from the perspective of FIG. 11, due to the geometry of the quadrilateral shape of the leg structure, 301, the quadrilateral side, 322, that is opposite the encased quadrilateral side, 323, angles outward slightly, at the angle, omega, 324, from the dashed line, 325, which is parallel to the line, 326, along which the section, 311, of the thermoplastic sheet, 300, is folded. Referring to FIG. 11, as already discussed in detail, the geometry of the gap, 357, in the leg securing device, 330, is such that when the steel rod leg structure, 301, is in a deployed position, it is at an angle to the surface of the sheet of thermoplastic material, 300. Because the material of the leg securing device, 330, is rubbery, such that it deforms only slightly when a moderate pressure is applied to an area of the surface of the material, the dimensions of the gap, 357, within the leg securing device, 330, can be sized such that the leg structure, 301, must slightly deform the material of the leg securing device, 330, as the leg structure, 301, is situated in a deployed position. Thus, when the leg securing device is deployed, it will remain securely in position. In addition, the fact that the leg structures, when deployed, are in a slightly splayed position with respect to the plane of the sheet of thermoplastic material, 300, causes downward force on the legs to push them against the inner terminus, 399, of the gap, 357. These structural features of the second preferred embodiment of the present invention ensure that the document holder is solid and stable when in use.

Figure 12:
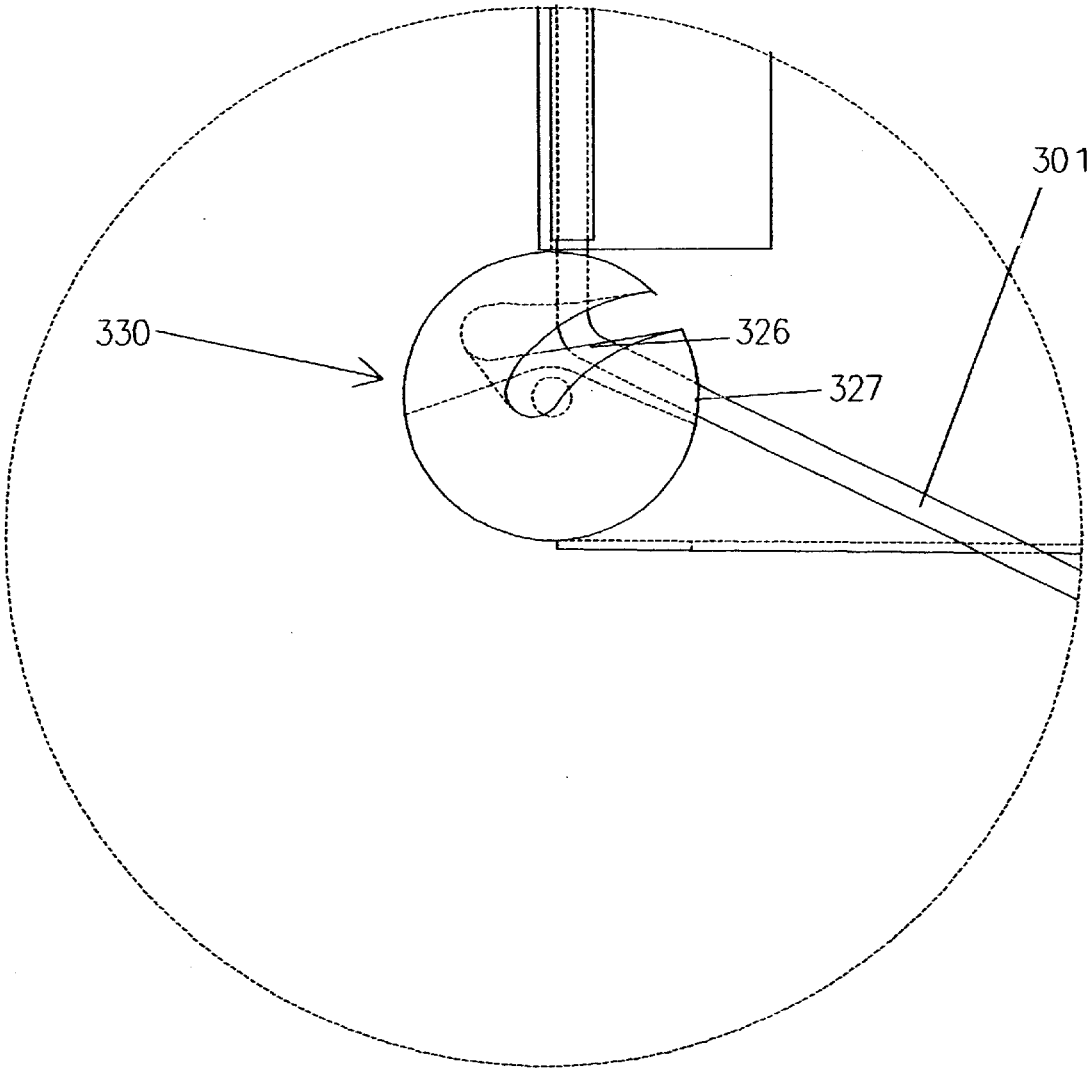
FIG. 12 is a bottom view of a detail area of a second preferred embodiment sheet of material, with a leg securing device and with a quadrilateral leg structure

FIG. 12 illustrates the same bottom view of FIG. 10 as does FIG. 11. However, FIG. 12 illustrates the quadrilateral leg structure, 301, as secured in a retracted position by the leg securing device, 330, which has been rotated counterclockwise with respect to it's position as illustrated in FIG. 11. This rotation is such that, referring now to FIG. 8*c*, part of the second section, 342, is, referring again to FIG. 12, over part of the quadrilateral leg structure, 301, between the points, 326 and 327. Referring to FIG. 8*c*, if the height of the first section, 341 is, referring now to FIG. 12, slightly less than the thickness of the rod of the quadrilateral leg structure, 301, then the slightly deformable material of the leg securing device, 330, will hold the quadrilateral leg structure, 301, securely in the retracted position.

Although the leg securing device, 330, has been illustrated with respect to only one side of the second preferred embodiment of the document holder, 2, of FIG. 7, it will be understood that a mirror-image of the device will function in an equivalent way on the other side of the document holder, 2, of the second preferred embodiment.

It will be understood that while the second preferred embodiment has been presented and described with respect to a sized, heat formed sheet of thermoplastic material, an equivalent rendering can be of any sized, heat formed structure of thermoplastic, thermosetting, or thermosetting and filler material.

Third Preferred Embodiment

Because the third preferred embodiment is equivalent in many ways to the first preferred embodiment, equivalences will be noted with reference to the first preferred embodiment, rather than described in detail.

Whereas the first preferred embodiment comprises a single, sized, heat formed sheet of transparent thermoplastic material, and is rendered with a manufacturing process designed to be economical for small production volumes, the third preferred embodiment comprises a sized, heat formed structure of thermoplastic, thermosetting, and/or thermosetting and filler material. The first and third preferred embodiments comprise an equivalent, optional standalone monitor riser.

The shape, structure, and function of the third preferred embodiment of the computer document holder are so similar to the first preferred embodiment that they can be regarded as equivalent. Regarding shape and structure, equivalences of the first and third preferred embodiments comprise a free-standing computer document holder, having a rectangular viewing surface, having a front top flange, and supported by two quadrilateral side structures, the side structures resting on a work surface, such that the rear quadrilateral edge of each side structure is longer than the front quadrilateral edge, thus positioning the rectangular viewing surface at an angle to the work surface, such that when documents are placed on the rectangular viewing surface, the top of a document is higher than the bottom of the document with respect to the work surface. Regarding shape and structure, equivalences between the first and third preferred embodiments further comprise either the reinforcing rear bottom flange of the first preferred embodiment, or any functionally equivalent reinforcing structure for the third preferred embodiment, and either the reinforcing folded rear edges of the quadrilateral side structures of the first preferred embodiment, or any functionally equivalent reinforcing structure for the third preferred embodiment. Regarding shape and structure, equivalences between the first and third preferred embodiments further comprise dimensions, and ranges of dimensions, for the lengths of the two shorter sides and the two longer sides of the rectangular viewing surface, and the lengths of the quadrilateral sides of the edge structures. Regarding shape and structure, equivalences between the first and third preferred embodiments further comprise the angle between the planes of the front top flange and the rectangular viewing surface, the angle between the planes of the rear bottom flange and the rectangular viewing surface, and the angle between the planes of the quadrilateral side structures and the rectangular viewing surface. The use and function of the first and third preferred embodiments is equivalent, comprising the use of the computer document holder as situated in front of, and/or over, and/or to the rear of, a computer keyboard, and the presentation of documents to a computer user.

The material used for the third preferred embodiment comprises thermoplastic, thermosetting, and/or thermosetting and filler material. The manufacturing process used for the third preferred embodiment comprises injection molding and transfer molding. Although such manufacturing processes require the use of one or more molds, and thus a higher capital investment, advantages of the third preferred embodiment that result from this process can include a sturdier structure, due to the use of thermosetting material, and/or thermosetting and filler material. For high volume production, economies of scale can result in a manufacturing cost for the third preferred embodiment that will compare favorably with the manufacturing cost for the first preferred embodiment.

It will be understood that the structure of the third preferred embodiment can comprise a single sized, formed piece, or, alternatively, an assembled structure of multiple sized, formed pieces, of either the same material, or of different materials, and that-the assembly of the multiple, sized, formed pieces can be by any means. It will be further understood that the structure of the third preferred embodiment can be either entirely transparent, or can be entirely non-transparent, or can include elements, such as, for example, the rectangular viewing surface and the front top flange, that are transparent, and other elements, such as, for example, the quadrilateral side structures, that are non-transparent.

Fourth Preferred Embodiment

Because the fourth preferred embodiment is equivalent in many ways to the third preferred embodiment, only differences in the material and manufacturing process will be noted here. Whereas the third preferred embodiment comprises a sized, heat formed structure of thermoplastic, thermosetting, and/or thermosetting and filler material, the fourth preferred embodiment comprises a structure made partially or entirely of wood, and optionally comprising decorative woodworking elements, such as, for example scrolling. The first and fourth preferred embodiments comprise an equivalent, optional stand-alone monitor riser.

Because the shape, structure, and function of the third and fourth preferred embodiments of the computer document holder are equivalent, the equivalences stated above regarding the third and first preferred embodiments will not be restated here, but are incorporated by reference. It will be understood that the relative durability of the third and fourth preferred embodiments may differ due to the different materials used.

The manufacturing process for the fourth preferred embodiment can comprise all standard processes used in the art of woodworking.

It will be understood that the structure of the fourth preferred embodiment can be entirely of wood, or can comprise multiple sized, formed pieces, of either wood, or of wood and any other rigid, durable materials, including any or all of the materials used for the first and third preferred embodiments. When the fourth preferred embodiment comprises multiple sized, formed pieces, the assembly of the multiple sized, formed pieces can be by any means. It will be further understood that the structure of the fourth preferred embodiment can be entirely non-transparent, or can include elements, such as, for example, the rectangular viewing surface and the front top flange, that are transparent, and other elements, such as, for example, the quadrilateral side structures, that are non-transparent.

Figure 13:
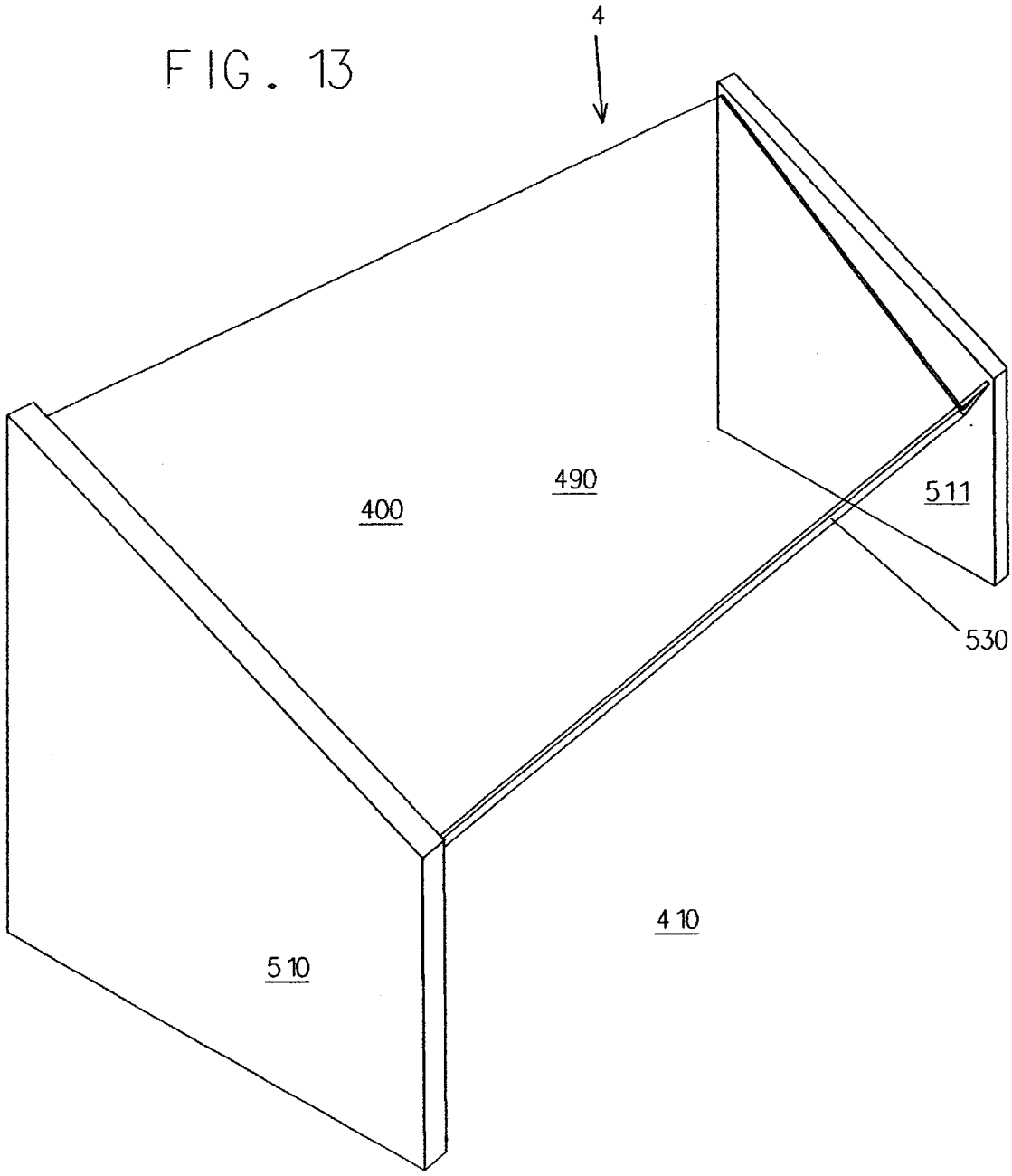
FIG. 13 is a top side perspective of a fourth preferred embodiment

FIG. 13 illustrates a top side perspective of a free-standing computer document holder of the fourth preferred embodiment. The document holder, 4, is situated on a work surface, 410, and has a structure comprising a sheet of sized, formed, thermoplastic material, 400, having a rectangular viewing surface, 490, and having a heat formed front top flange, 530, and left and right wood quadrilateral side structures, 510 and 511, respectively. Although the sheet of sized, formed, thermoplastic material, 400, of FIG. 13 is transparent, alternatively, it could be non-transparent.

Figure 13A:
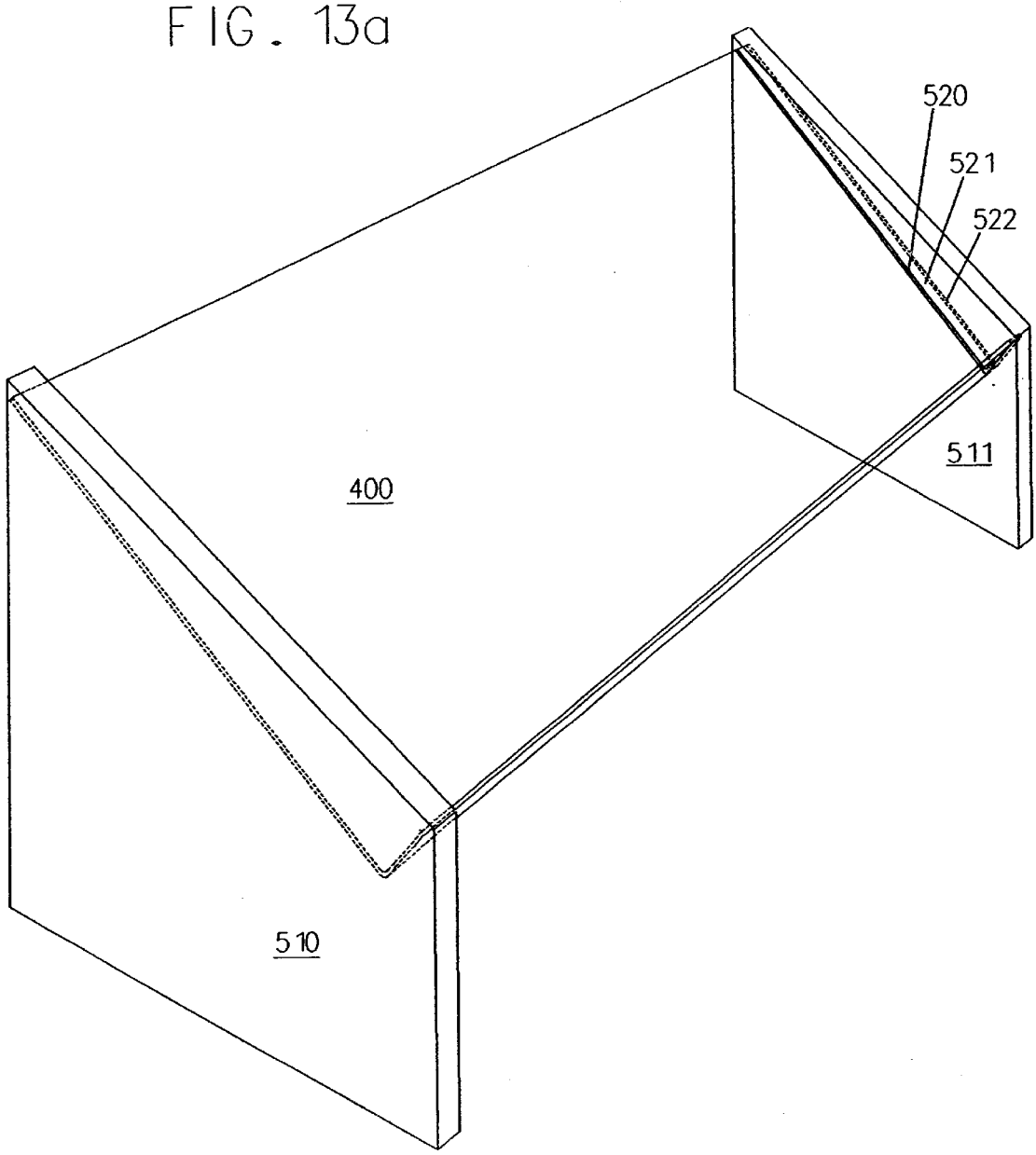
FIG. 13*a* is a top side perspective of a fourth preferred embodiment

FIG. 13*a* is similar to FIG. 13, however, the entire sheet of sized, heat formed, thermoplastic material, 460, is illustrated, with dashed lines indicating sections of the thermoplastic material where the line of site is obstructed by the left and right wood quadrilateral side structures, 510 and 511. The left and right wood quadrilateral side structures have grooves on their inner surfaces that are sized to the dimensions of the left and right sides of the sheet of sized, heat formed thermoplastic material. Regarding the manufacturing process, these grooves can be easily rendered with inexpensive, commercially available routers, having cutting edges similar to drill bits, but suitable for cutting grooves within wood structures. As FIG. 13*a* illustrates for the right wood quadrilateral side structure, 511, the groove, 520, on the inner side of the wood quadrilateral side structure, 511, is shaped and sized to enclose and secure an edge section, 521, of the sheet of sized, heat formed thermoplastic material, 400. The right terminus of the edge section, 521, is illustrated by the dashed lines, 522. The left side of the sheet of sized, heat formed thermoplastic material, 400, is attached to the left wood quadrilateral side structure, 510, in a similar manner. Glue, or other adhesive material, or other means, can be used to permanently attach edge sections of the sheet of sized, heat formed thermoplastic material, 400, to the wood quadrilateral side structures, when the edge sections are situated within the grooves in the wood quadrilateral side structures. The left and right wood quadrilateral side structures, 510 and 511, can have decorative woodworking elements, although such decorative woodworking is not illustrated.

What is claimed is:

1. A free-standing computer document holder, situated in front of, and/or over, and/or to the rear of, a computer keyboard, comprising a sized, heat formed structure of thermoplastic, and/or thermosetting, and/or thermosetting and filler material, the said document holder having:

a. a rectangular viewing surface, having left and right shorter sides, and front and back longer sides, and positioned at an angle to a work surface, and supporting and presenting documents to a computer user, and b. left and right quadrilateral sides, such that the said sides rest on a work surface, and support the said rectangular viewing surface, and c. the said quadrilateral sides formed such that they are on a plane at approximately a 90 degree angle to the plane of the said rectangular viewing surface, and d. the length of the rear edge of the said quadrilateral sides being greater than the length of the front edge of the said quadrilateral sides, such that the top of a document on the said rectangular viewing surface is elevated above the bottom of the said document with respect to the said work surface, and e. the said rectangular viewing surface having a front top flange, such that the said front top flange is on a plane at approximately a 90 degree angle to the plane of the said rectangular viewing surface, and, f. the said document holder having a folded rear bottom flange.

2. The computer document holder of claim 1, such that the said folded rear bottom flange is on a plane at approximately a 90 degree angle to the said work surface.

3. The computer document holder of claim 1, further comprising the said right and left quadrilateral sides having folded rear edges.

4. The computer document holder of claim 1, further comprising the said right and left quadrilateral sides having reinforced rear edges.

5. The computer document holder of claim 1, further comprising a stand-alone computer monitor riser unit, situated on the said work surface beneath a monitor, and elevating the said monitor such that the entire monitor screen is visible to the said computer user.

6. The computer document holder of claim 1, further comprising a rectangular viewing surface having left and right shorter sides, each said shorter side having an equal length of approximately 10 inches, and the said rectangular view surface having front and back longer sides, each said longer side having an equal length in a range from approximately 20 inches to approximately 36 inches.

7. The computer document holder of claim 1, further comprising the said quadrilateral sides having bottom edges encased by a layer of rubbery material.

8. The computer document holder of claim 1, further comprising the said quadrilateral sides having folded rear side edges that are set back approximately one-half inch from the bottom side edge, the said bottom side edge being encased by a layer of rubbery material.

9. The computer document holder of claim 1, such that the said sized, heat formed structure of thermoplastic or thermosetting material is transparent.

10. A free-standing, portable computer document holder, situated in front of, and/or over, and/or to the rear of, a computer keyboard, comprising a sized, heat formed structure of thermoplastic, and/or thermosetting, and/or thermosetting and filler material, the said document holder having:

a. a rectangular viewing surface, having left and right shorter sides, and front and back longer sides, and positioned at an angle to a work surface, and supporting and presenting documents to a computer user, and b. left and right folding quadrilateral leg structures, made of metal rod, or a similar durable, rigid, formable material, and attached to the said sized, heat formed structure, such that when deployed, the said quadrilateral leg structures are in a slightly splayed position, resting on a work surface, and supporting the said upper rectangular viewing surface, and c. the length of the rear side of each said quadrilateral leg structure being greater than the length of the front side of each said quadrilateral leg structure, such that when the said quadrilateral leg structures are in a deployed position, the top of a document on the said rectangular viewing surface is elevated above the bottom of the said document with respect to the said work surface, and d. each said quadrilateral leg structure securable in either a deployed or a retracted position by a leg securing device.

11. The portable computer document holder of claim 10, further comprising the said quadrilateral leg structures having upper sides enclosed in a tube, each said upper side of each said quadrilateral leg structure being able to rotate within the said tube, and each said tube, together with the said tube-enclosed quadrilateral leg structure, being attached to the said sized, heat formed structure, by an encasing, heat formed, folded left or right protruding section, such that the surface of the said protruding section is brought into contact with the under side of the said rectangular viewing surface.

12. The portable computer document holder and leg securing device of claim 10, the said leg securing device further comprising a cylindrical section of rubbery material, having an inner side attached to a bottom corner of the under side of the said sized, heat formed structure, the said leg securing device having a gap to accommodate movement of one of the said quadrilateral leg structures within the said gap, the width of the said gap being slightly narrower than the width of the rod of the said quadrilateral leg structure, such that the said quadrilateral leg structure slightly deforms the leg securing device, and is gripped and secured by the leg securing device, when the said quadrilateral leg structure is in the said deployed position, and the said leg securing device having a surface of the said lower side recessed from the under side of the said sized, heat formed structure by a distance slightly less than the said width of the rod of the said quadrilateral leg structure, such that when the said quadrilateral leg structure is in a retracted position, against the said under side of the said sized, heat formed structure, the said leg securing device is rotatable such that a part of the said recessed surface of the said lower side is over the said quadrilateral leg structure, and such that the said quadrilateral leg structure slightly deforms the said recessed surface of the said lower side, and is gripped and secured by the said leg securing device when the said quadrilateral leg structure is in the said retracted position.

13. The portable computer document holder and leg securing device of claim 12, the said leg securing device further comprising a terminus reinforcing structure of rigid, durable material, attached to an outer side of the said leg securing device, such that the said terminus reinforcing structure stops the quadrilateral leg structure at the inner terminus of the said gap in the said leg securing device.

14. The portable computer document holder of claim 10, further comprising a standalone monitor riser unit, situated on the said work surface beneath a computer monitor, and elevating the said computer monitor such that the entire monitor screen is visible to the computer user.

15. The portable computer document holder of claim 10, further comprising a rectangular viewing surface having left and right shorter sides, each said shorter-side having an equal length of approximately ten inches, and the said rectangular view surface having front and back longer sides, each said longer side having an equal length in a range from approximately 20 inches to approximately 36 inches.

16. The portable computer document holder of claim 10, further comprising a handle-sized gap at the upper center of the said rectangular viewing surface.

* * * * *